US006490429B2

(12) United States Patent
Okayasu et al.

(10) Patent No.: US 6,490,429 B2
(45) Date of Patent: Dec. 3, 2002

(54) HEAT FIXING MEMBER HAVING CORE METAL AND RELEASE LAYER, HEAT AND PRESSURE FIXING APPARATUS, AND IMAGE FORMING APPARATUS

(75) Inventors: Takahiro Okayasu, Minamiashigara (JP); Hiroshi Tamemasa, Minamiashigara (JP); Issei Fujihara, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/918,490

(22) Filed: Aug. 1, 2001

(65) Prior Publication Data

US 2002/0085866 A1 Jul. 4, 2002

(30) Foreign Application Priority Data

Nov. 14, 2000 (JP) ..... 2000-347080

(51) Int. Cl.[7] ..... G03G 15/20

(52) U.S. Cl. ..... 399/328; 399/330; 399/331; 399/333

(58) Field of Search ..... 219/216; 29/895.2, 29/895.21, 895.3; 399/328, 330, 331, 333

(56) References Cited

U.S. PATENT DOCUMENTS 5,887,237 A * 3/1999 Matsumoto et al. ..... 399/333

FOREIGN PATENT DOCUMENTS

| | | |
|---|---|---|
| JP | 59-155875 A | 9/1984 |
| JP | 2-149628 A | 6/1990 |
| JP | 10-240059 A | 9/1998 |
| JP | 11-149226 A | 6/1999 |

* cited by examiner

*Primary Examiner*—Hoang Ngo
(74) *Attorney, Agent, or Firm*—Oliff & Berridge, PLC

(57) ABSTRACT

The invention relates to a cylindrical heat fixing member in which in a fixing apparatus for fixing an unfixed toner image carried onto a recording material heats and pressurizes the recording material and which heat fixing member is formed by at least a release layer being formed on the peripheral surface of a core metal. In the heat fixing member, the thickness of the core metal is from 0.5 mm to 2.8 mm inclusive and the core metal material is an aluminum alloy that is elastically deformed by a stress of 60.0 Mpa at 210° C. The invention also relates to a heat and pressure fixing apparatus and an image formation apparatus using the heat fixing member.

23 Claims, 5 Drawing Sheets

HEAT FIXING MEMBER HAVING CORE METAL AND RELEASE LAYER, HEAT AND PRESSURE FIXING APPARATUS, AND IMAGE FORMING APPARATUS

BACKGROUND OF THE INVENTION

1. Field of the Invention

The present invention relates to a heat fixing member which applies heat and pressure to a recording material, and is disposed in a fixing apparatus which uses a heat and pressure fixing method, the fixing apparatus being used in an image formation apparatus using electro-photography such as a copier, a printer, facsimile machine and the like. The invention also relates to a heat and pressure fixing apparatus and an image formation apparatus which use said heat fixing member.

2. Description of the Related Art

Conventionally, in a copier, printer, etc. that utilizes an electro-photography, it is necessary to perform fixing of a unfixed toner image formed on a recording material, thereby making that unfixed toner image a permanent image. As a method for performing such fixing, there are known a solvent fixing method, a pressure fixing method, and a heat and pressure fixing method.

However, the solvent fixing method has the drawback that the solvent gives off vapor, and this causes problems in terms of odor and sanitation. On the other hand, the pressure fixing method has the drawback that the fixability is inferior to that obtained with the use of other mixing methods and that the pressure-sensitive toner is expensive. For those reasons, the solvent fixing method and pressure fixing method have not been put to practical use. The actual situation is that the heat and pressure fixing method has instead been generally widely used.

In the heat and pressure fixing method, the following technique is the most widely used. Namely, of a heating roll that is a heat fixing member and a pressure roll that is a pressure applying member, at least inside the heating roll, there is disposed a heat source. The both rolls are pressure-contacted with each other to thereby form a nip portion. And, while they are being rotated, a recording material having formed thereon a unfixed toner image is inserted through the nip portion. By doing so, the toner is molten and pressurized and is fixed onto the recording material. In this type of heating roll, on the surface of a hollow-cylindrical core metal, a heat-resisting release layer is provided as at least a surface layer. By doing so, the toner is prevented from adhering onto the heating roll. Particularly, if only color fixing apparatus are considered, there are many cases where, for the purpose of evenly conducting heat to the toner of each color, an elastic layer is provided between the core metal and the release layer. And this elastic layer may function to cover the laminated toners therein. On the other hand, the pressure roll is generally of a type wherein a heat-resisting elastic layer and, according to the necessity, a heat-resisting release layer are sequentially applied to the surface of the hollow-cylindrical or solid core metal.

In general, the thickness of the elastic layer is made greater than a certain value to thereby cause the deformation of the elastic layer of each of the rolls through the use of the nip pressure. The nip width is ensured by that deformation. Conventionally, the elastic layer is generally constructed of a heat-resisting rubber such as silicone rubber or fluorine rubber since these have large heat capacity. A time period of 3 to 8 minutes or so was needed for it to rise from room temperature. Thus in order to minimize the waiting period when a print job was received (or when there was an attempt to make a copy), even when the device was in a standby state, the temperature was kept at high temperature which was gather room temperature, but less than the temperature at which fixing is carried out. Because of this, most of the power consumed in the electro-photographic image formation apparatus was attributable to the operation of the fixing apparatus.

In order to solve this problem, decreasing the thickness of the heat fixing member as a whole is the most effective means. In order to obtain an excellent quality of fixed image,the thickness of the elastic layer must exceed a certain level. Especially, in a color copier/printer, toner images that correspond to 4 colors of yellow, magenta, cyan, and monochrome black are superposed one upon the other. Therefore, in order to equally conduct heat to the toner in a state in which all four color layers are superimposed and prevent the toner images from being mechanically brought out of their original shape, the the elastic layer must be used. An attempt has been made to realize reaching a temperature at which fixing is possible in a short period of time by making the hollow-cylindrical metal core which becomes the core metal thin.

However, if the core metal is simply made thin, the rigidity of the core metal decreases. For this reason, there occurs the inconvenience that the core metal flexes initially due to the nip pressure occurring between itself and the pressure member, or that the metal core undergoes permanent deformation of the core metal due to long use or being left unused. As a result, the nip pressure is unevenly applied in the circumferential direction of the heat fixing member. Thus, there defects of the fixed image quality such as gloss unevenness or fixation defects at the area where the nip pressure is low are caused.

In contrast, Japanese Patent Application Laid-Open Publications (JP-A) Nos. 59-155875 and 11-149226 each propose the following. Namely, on the inner surface of the core metal are rib is formed in parallel with the axial direction, or formed spirally, to thereby increase the mechanical strength of the heating roll. However, in this method, unevenness is substantially created in the thickness of the core metal. Consequently unevenness occurs in the direction of heat conduction from the heater (the heat source). Thus, there occurs a temperature difference between the rib-containing portion and the no-rib portion on the surface of the heating roll. This is considered to cause defects in the fixed image. In addition, ordinarily, the core metal can achieve a required precision by being made into a pipe by extrusion of metal such as aluminum or iron and thereafter being drawn off. However, in this case when a rib is formed in the inner surface of the core metal, it becomes necessary to perform a complex step in terms of the working. Consequently, the processing cost is also increased.

Also, JP-A No. 10-240059 has proposed a method of increasing the mechanical strength by making a composite from an aluminum core metal and a resin layer. In this method, though, it is certainly possible to decrease the thickness of the aluminum core metal, because a resin such as epoxy constituting the resin layer is inferior in the conduction of heat to metal, there occurs the drawback that the period needed to reach to a temperature at which fixing is possible becomes large. Also, the adherence at the interface between the aluminum and the resin layer, or the durability thereof, is not sufficient. Therefore, when consideration is given to the fact that the core metal when used as a fixing member is used in an environment of high temperature, and that peeling occurs at the interface due to use for a long period, the core metal does not have sufficient mechanical strength.

Further, JP-A No. 2-149628 has proposed an invention that concerns an aluminum alloy having 1.0 to 5.0% Mn as an additive that is added to the aluminum itself. However, it cannot be said that that alloy having that composition ratio exhibits a sufficiently high level of extrusion workability. This leads to an increase in the working cost. Furthermore, bends that occurs due to use for a long period at a high temperature are likely to be formed.

SUMMARY OF THE INVENTION

Accordingly, the present invention has been made in order to solve the problems inherent in the above-described conventional techniques and has an object to provide a heat fixing member which while maintaining an image that is has a high image quality, enables shortening of the length of time needed until a temperature at which fixing is possible is reached, and a heat and pressure fixing apparatus that uses the heat fixing member. Another object of the present invention is to provide a highly durable heat fixing member which even when used for a long period of time and at a high temperature is prevented from being bent, and a heat and pressure fixing apparatus that uses the heat fixing member. A third object of the present invention is to provide an image formation apparatus that uses the heat and pressure fixing apparatus having such excellent characteristics.

The inventors of this patent application have discovered that the above-described problems can be solved by defining the characteristics of the materials that are used as the core metal of the heat fixing member, and this has led to the present invention. Namely, the present invention is as follows. A first aspect of the present invention is a heat fixing member for applying heat and pressure to the recording material in a fixing apparatus in order to fix an unfixed toner image carried thereon, the heat fixing member comprises:

a cylindrical core metal; and a release layer formed on a peripheral surface of the core metal, wherein the thickness of the core metal is 2.8 mm or less, and the core metal is formed of a material which is elastically deformed by a stress of 60.0 MPa in an environment of 210° C.

The heat fixing member according to the first aspect of the present invention, wherein the thickness of the core metal is no less than 0.5 mm.

The heat fixing member according to the first aspect of the present invention, wherein the core metal is formed of an aluminum alloy.

The heat fixing member according to the first aspect of the present invention, wherein the outer diameter of the core metal is from 20 to 40 mm. The heat fixing member according to the first aspect of the present invention, wherein the release layer consists of a fluorine containing polymer material.

The heat fixing member according to the first aspect of the present invention, wherein the thickness of the release layer is from 10 to 100 $\mu$m.

The heat fixing member according to the first aspect of the present invention, wherein at least an elastic layer is formed between the core metal and the release layer. The elastic layer may consist of silicone rubber, and the thickness of the elastic layer may be from 50 $\mu$m to 1.0 mm.

A second aspect of the present invention is a heat and pressure fixing apparatus for applying heat and pressure to a recording material in order to fix an unfixed toner image carried thereon, the heat and pressure fixing apparatus comprises:

a cylindrical heat fixing member;

a pressure applying member which is press-contacted with a peripheral surface of the heat fixing member to form a nip portion therebetween, through which the recording material is inserted; and a heat source disposed inside the heat fixing member, wherein the heat fixing member includes a core metal and a release layer formed on a peripheral surface of the core metal, the thickness of the core metal is from 0.5 mm to 2.8 mm, and the core metal is formed of an aluminum alloy that is elastically deformed by a stress of 60.0 MPa in an environment of 210° C.

The heat and pressure fixing apparatus according to the second aspect of the present invention, wherein the diameter of the core metal is from 20 to 40 mm.

The heat and pressure fixing apparatus according to the second aspect of the present invention, wherein the release layer consists of a fluorine containing polymer material.

The heat and pressure fixing apparatus according to the second aspect of the present invention, wherein the thickness of the release layer is from 10 to 100 $\mu$m.

The heat and pressure fixing apparatus according to the second aspect of the present invention, wherein at least an elastic layer is formed between the core metal and the release layer.

The heat and pressure fixing apparatus according to the second aspect of the present invention, wherein the elastic layer consists of silicone rubber.

The heat and pressure fixing apparatus according to the second aspect of the present invention, wherein the thickness of the elastic layer is from 50 $\mu$m to 1.0 mm.

The heat and pressure fixing apparatus according to the second aspect of the present invention, wherein heat and pressure is applied to the recording material by the heat fixing member being heated at a temperature of 100 to 210° C. and a load being applied thereto by the pressure applying member so as to provide a stress of no more than 60.0 MPa.

The heat and pressure fixing apparatus according to the second aspect of the present invention, wherein the pressure applying member includes an endless belt and a presser disposed inside the endless belt, the endless belt being wound around the heat fixing member at a predetermined angle to form a nip portion between the endless belt and the heat fixing member, through which a recording material is inserted, and a strain is caused on the surface of the heat fixing member by pressing the presser against the heat fixing member via the endless belt at the nip portion. The presser may be a pressure pad, and a nip pressure of the pressure pad that presses the heat fixing member may be locally large in the vicinity of an exit of the nip portion.

A third aspect of the present invention is a heat and pressure fixing apparatus for applying heat and pressure to a recording material in order to fix the unfixed toner image which is carried toner image thereon, the fixing apparatus comprises:

a cylindrical heat fixing member;

a pressure applying member that is press-contacted with a peripheral surface of the heat fixing member to form a nip portion through which the recording material is inserted; and a heat source disposed inside the heat fixing member, wherein the heat fixing member includes a core metal and a release layer formed around the core metal, the thickness of the core metal is no more than 2.8 mm, and at the time of fixation the heat fixing member is elastically deformed by a load applied so as to produce a stress of no more than 60.0 MPa from the pressure applying member.

The heat and pressure fixing apparatus according to the third aspect of the present invention, wherein the load applied to the heat fixing member by the pressure applying member produces a stress of no less than 25.0 MPa.

A fourth aspect of the present invention is an image formation apparatus, comprises:

an electrostatic latent image formation device that forms an electrostatic latent image on an electrostatic latent image carrier;

a development device which develops the electrostatic image by the use of toner;

a transfer device which transfers the developed toner image onto a recording material; and a fixation device which fixes the transferred toner image on the recording material, wherein the fixation device includes a cylindrical heat fixing member, a pressure applying member which is press-contacted with a peripheral surface of the heat fixing member to form a nip portion through which the recording material is inserted, and a heat source that is disposed inside the heating fixing member, and the heat fixing member includes a core metal and a release layer formed on the peripheral surface of the core metal, and wherein the thickness of the core metal is from 0.5 mm to 2.8 mm, and the core metal is formed of an aluminum alloy that is elastically deformed by a stress of 60.0 MPa in an environment of 210° C.

A fifth aspect of the present invention is an image formation apparatus comprises:

an electrostatic latent image formation device forming an electrostatic latent image on an electrostatic latent image carrier;

a development device which develops the electrostatic image by the use of toner;

a transfer device which transfers the developed toner image onto a recording material; and a fixation device which fixes the transferred toner image on the recording material, wherein the fixation device includes a cylindrical heat fixing member, a pressure applying member which is press-contacted with a peripheral surface of the heat fixing member to form a nip portion through which the recording material is inserted, and a heat source that is disposed inside the heat fixing member, and the heat fixing member includes a core metal and a release layer formed on the peripheral surface of the core metal, the thickness of the core metal is no more than 2.8 mm, and at the time of fixation the heat fixing member is elastically deformed by a load applied so as to produce a stress from the pressure applying member of no more than 60.0 MPa.

One feature of the present invention is using as a material for the core metal of the heat fixing member, a material that can be elastically deformed even under conditions where the maximum stress of the fixing load is applied and the temperature is the upper limit of the temperature range for fixing.

In general, up until now, a material for a core metal of the heat fixing member which can be left unused for a long period, and which has the pressure applying member and the nip portion formed, has been suitably selected based on JIS standards (in the case of an aluminum alloy, JIS-H0001 etc.). The selection is made such that the strength is sufficient for the purpose for which it is to be used. However, since some materials which are suitable based on the characteristic values prescribed by some of the JIS standards do not exist, errors were sometimes made in the important selection of the material. Generally, such physical-characteristic values of the material are the ones that have in many cases are measured at normal temperature. Also, the physical characteristic values include, such values as the proof stress, mechanical strength, or creep deformation as measured with the tensile test. Accordingly, when the state of use inside the fixing apparatus is given sufficient consideration, it is virtually impossible to simply select the relevant suitable material based on the characteristic values described in JIS standard.

On that account, the inventors of this patent application first have considered the circumstances under which a material is used as the heat fixing member. And in order to find a high-strength material with that taken into consideration, they have come up with the following. Namely, a core metal is fixed in a state of being supported at each of its ends and in a state of high temperature state which is at the upper-limit of temperature at which fixing is possible range for fixing. They then have then, when the core metal has been fixed as such, a load may be applied, as one-point load, to the center of the core metal so that, when a fixation load has been applied, the resulting stress is the greatest or maximum. And they have selected a material for the core metal which is not substantially deformed before or after the time when that load is applied. (Namely, a material that is elastically deformed, even under the conditions where it the maximum stress is generated, by the fixation load, at the upper-limit temperature of the temperature at which fixing is possible range for fixing.) They thereby have discovered that such selected material can exhibit a strength that corresponds to the circumstances of use thereof as the heat fixing member. Further, by defining the thickness of that material, they have also discovered that it is possible to obtain the heat fixing member in which period of time needed until a temperature at which fixing is possible is reached, is decreased (i.e. which has excellent instant startability characteristic).

Further, through using the above-described heat fixing member and again through defining the temperature and load (stress) of the heat fixing member during the use thereof, they have also discovered the following. That is, they have discovered a heat fixing apparatus (hereinafter there are cases in which it is referred to simply as "the fixing apparatus") that has excellent startability characteristic and that exhibits no deformation of the heat fixing member even when it is left to stand for a long period of time.

That is, through applying to the fixing apparatus the heat fixing member based on the use of the material satisfying the characteristic defined in the present invention, it is possible, while maintaining the quality of the obtained image at a high level, to shorten the length of time needed until a temperature at which fixing is possible is reached.

DESCRIPTION OF THE PREFERRED EMBODIMENTS

Figure 1:
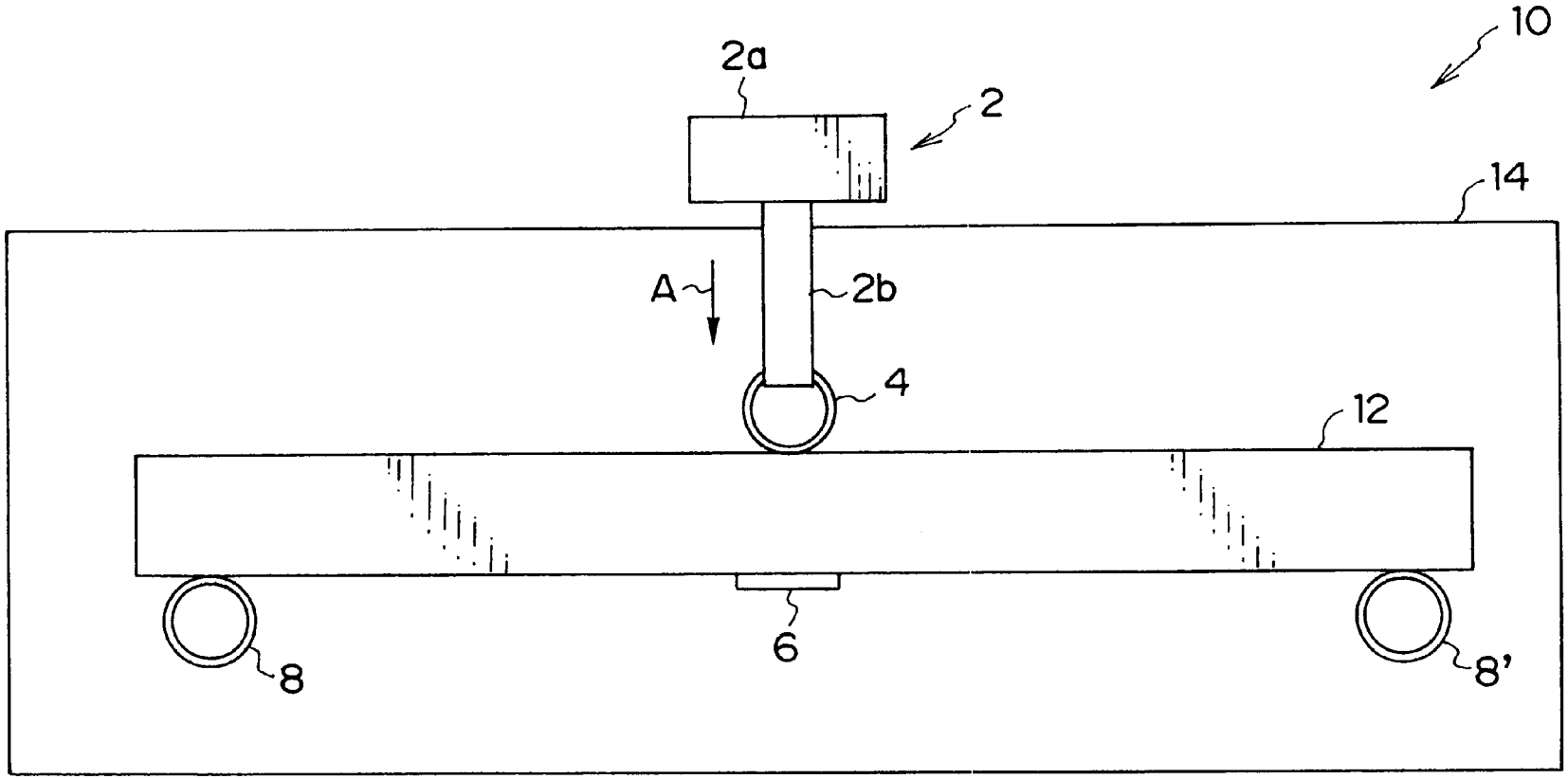
FIG. 1 is a schematic structural view of a measuring device for measuring the elastic-deformation index $\epsilon$.

The present invention will now be explained in detail below.

[Heat Fixing Member]

A heat fixing member of the present invention is a hollow-cylindrical heat fixing member that, in a fixing apparatus for fixing unfixed toner images carried on a recording material, heats and pressurizes the recording material and has a core metal on the circumferential surface and thereon is formed at least a release layer.

The thickness of the core metal of the heat fixing member is 2.8 mm or less; and the material of the core metal is the one that is elastically deformed, in an environment of 210° C., with respect to the stress of 60.0 MPa.

While the heat fixing member of the present invention is the one wherein at least a release layer is formed on the circumferential surface of the core metal, an elastic layer is suitably formed between the core metal and the release layer. A description will now be given of each constituent element of the heat fixing member (Core Metal)

1) Material of the Core Metal

The material of the core metal of the heat fixing member of the present invention is the one that in an environment of 210° C. is elastically deformed with respect to the stress of 60.0 MPa. Specifically, this means the following. First, in a state where the cylindrical core metal which is the object of the stress is heated at 210° C., a central one-point load is applied thereto. In this condition, at a position which in the circumferential direction is exactly oppsite to the position at which the load is being applied to the core-metal material, it is assumed that when the stress the core-metal material receives per sectional area at that position is 60.0 Mpa, the core-metal material is elastically deformable. Then, that material is defined as being usable as the material of the core metal. Such a property that is characteristic of the present invention is hereinafter referred to as "a high-temperature elasticity characteristic".

Here, the expression "elastic deformation" means deformation that occurs when a load is applied so that the stress has a prescribed value, and when that load has been thereafter removed the deformation is restored to the original shape. In contrast to this, a case where when that load has been removed the deformation is not restored into the original shape and consequently deformation remains, is referred to as "plastic deformation". Actually, in most cases the deformation is not completely restored to the original shape. Therefore, a case corresponding to a state where it can be said that the deformation has been substantially restored into the original shape is included under the category of "elastic deformation". The index of the "elastic deformation" can be defined as follows. Specifically, lines which indicate the interval 1 which is in a longitudinal direction, are drawn before hand at the position of the cylindrical core metal which is opposite, in the circumferential direction, to the position at which the load is applied. In this condition, the load is applied so that the stress the core metal receives per sectional area on the side having the line marks drawn thereon is 60.0 MPa. It is possible to use the value of $\Delta 1/1$ as the index of the "elastic deformation", in a case when that load has been removed and the distance between the line marks becomes $1+\Delta 1$. Hereinafter, this value of $\Delta 1/1$ is referred to as "the elastic-deformation index $\epsilon$".

If the value of the elastic-deformation index $\epsilon$ is not more than $120\times10^{-6}$, when estimated under the test conditions, the relevant material can be said to satisfy the requirement of "being elastically deformed". In a more preferable elastic-deformed state, the value of the elastic-deformation index $\epsilon$ is not more than $100\times10^{-6}$, more preferably not more than $80\times10^{-6}$, and particularly not more than $50\times10^{-6}$.

The definition of the present invention, in other words, can be said to be made under the assumption that the conditions for measuring the elastic-deformation index $\epsilon$ are the ones that prevail in an environment of 210° C. and when a stress of 60.0 MPa has been applied to the material. Here, an explanation will now be given of the significance of those conditions. In addition to taking the situation in which the heat fixing member will be used into consideration, it is assumed that the conditions are such that the temperature is the upper limit of the temperature range at which fixing can be carried out, and a maximum stress of the fixing load is applied.

In the temperature range which exceeds 210° C., generally, the temperature exceeds the heat-resistance limit of the elastic layer that is formed on the surface of the heat fixing member. For this reason, as the upper limit of the fixing temperature range, a temperature of 210° C. is adopted. On the other hand, in an ordinary system for fixing and melting the toner and pressurizing it to thereby fix it, a high pressure at which the stress is not less than 60.0 MPa is not ordinarily applied. But, when applying the load so that the resulting stress may become more than 60.0 MPa, the probability that the heat fixing member itself will be flexed becomes high. Owing thereto, the probability that inconveniences such as paper wrinkles, image dragging, or fixation defects that occur due to defective conveyance becomes high. Also, there are cases where the decrease in durability such as wear of the surface layer, decrease in releasability, or creation of the surface scratches is caused. Further, in the heat fixing member having an elastic layer, because the elastic layer receives a high pressure at the nip portion, the layer becomes likely to be destroyed due to the decrease in the elasticity of the rubber. Additionally, there are also cases where the bonding strength decreases at each interface between the release layer, the elastic layer, and the core metal with the result that peeling occurs.

An example of a specific method of measuring the elastic-deformation $\epsilon$ will be explained below.

As a measuring device for measuring the elastic-deformation $\epsilon$, for example, an digital static material testing machine manufactured by Instron or the like can be used. FIG. 1 is a schematic structural view of the measuring device for measuring the elastic-deformation $\epsilon$. This measuring device 10 is constructed of a load cell 2, a crosshead 4, a strain gauge 6, and fulcrums 8, 8'. A measured sample 12 that is a circular-cylindrical core metal is placed on the fulcrums 8, 8' in a state where its peripheral surface is in contact with these fulcrums 8, 8'. The load cell 2 is constructed of a load cell main body 2*a* and a rod portion 2*b* having attached at its forward end the cross-head 4. It thus extrudes the cross-head 4 in a direction indicated by arrow A to thereby apply a load to a central part of the peripheral surface of the measured sample 12. The cross-head 4 is an iron-made circular-cylindrical member having a diameter of 10 mm ϕ, while the fulcrums 8, 8' each are circular-cylindrical member made of stainless steel and having a diameter of 10 mm ϕ.

The distance between the fulcrums 8 and 8' is made to be, for example, 290 mm. Regarding the position of abutment between the cross-head 4 and the measured sample 12, these members are disposed so that the cross-head 4 may be situated at the center between the fulcrums 8 and 8' when the position of the cross-head 4 is viewed in the axial direction of the measured sample 12. A strain gauge 6 is mounted about a position that is taken exactly on a circumferentially-opposite side to the position (the abutment position between the cross-head 4 and the measured sample 12) at which a load is applied to the measured sample 12. Here, as the strain gauge 6, there was used a strain gauge the gauge length of which is 2 mm and that is produced by Kyowa Dengyo Limited.

The entire measuring device 10, within which the measured sample 12 has been placed, is disposed within a high-temperature tub 14 so that the load main body 2*a* which is of the load cell 2, may be situated outside and the rod portion 2*b* may be extended from outside the tub into the inside of the same. The high-temperature tube 14 has an oil filled therein, the oil being maintained at 210° C. As the oil, there is suitably used silicone oil.

A procedure for measuring the elastic-deformation index ϵ corresponding to a prescribed stress will be explained below with the use of the measuring device 10.

The load cell 2 is operated as follows. The rod portion 2*b* is extruded in the arrow-A direction at an extrusion speed of 0.5 mm/min. so that the cross-head 4 may abut on the measured sample 12. And, the rod portion 2*b* continues to be extruded until the stress becomes 50 MPa. Namely, a load is thereby applied to the measuring sample 12 by means of the cross-head 4.

It is to be noted that the load which becomes the above-described stress can be determined by calculation that is performed under the conditions of, or using as the conditions, the outer diameter and thickness of the measured sample 12 and the distance between the fulcrums 8 and 8'. The specific method of calculation is described in detail in literatures such as. The strength-of-materials system, or, for example, The Handbook on Mechanical Designing by Science/Engineering Company Limited.

Thereafter, the rod portion 2*b* is drawn upward in a direction opposite to the arrow-A direction to thereby remove the load.

After removing the load, the elastic-deformation index ϵ can be determined from the remaining amount of strain obtained from the strain gauge 6.

From the value of the elastic-deformation index ϵ that has thus been determined, it is possible to determine whether the measured sample 12 has a high-temperature elasticity characteristic.

Additionally, the size (outside diameter, axial length, and thickness) of the measured sample 12 is set to be the one that it is when it is actually used as the core metal of the heat fixing member. Accordingly, in case the axial length (this axial length is sometimes referred to simply as "the length") is less than 300 mm, it is preferable to adjust the distance between the fulcrums 8 and 8' suitably. Of course, regarding the measured sample 12 which is 300 mm long or more, the distance between the fulcrums 8 and 8' does not need to be limited to 290 mm and can be freely selected.

The above-described method of measuring the elastic-deformation index ϵ is only illustrative, and the measuring conditions (excluding the temperature and the stress), measuring devices, etc. can be suitably selected.

As the above-described material of high-temperature elasticity characteristic, no particular limitation is imposed and various kinds of metal materials can be used. However, that material particularly preferably, is aluminum alloy. As aluminum alloy, various kinds of alloy compositions can be used. However, in the present invention, there is no particular limitation upon the alloy composition so long as it exhibits the above-described high-temperature elasticity characteristic. That is, it is sufficient to actually measure the deformation index ϵ and select an aluminum alloy of a composition having the above-described high temperature elasticity characteristic.

An example of a specific alloy composition that is usable as the aluminum alloy having the high-temperature elasticity characteristic is shown below. However, of course, the present invention is not limited to the below-mentioned alloy composition. Further, if it is even within the below-mentioned composition ratio, the material that is determined as not having the high-temperature elasticity characteristic because the measured result of the elastic-deformation index ϵ will be considered outside the range of the material specified for use in the present invention. Additionally, minute amounts of components such as unavoidable impurities, may cause the measured result of the elastic-deformation index ϵ to vary.

<Example of the Specific Percentage Alloy Composition>

The aluminum alloy that is obtained as follows. An amount of manganese (Mn) of 0.1 to 0.9% and an amount of magnesium (Mg) of 0.1 to 2.0% are blended with each other. To the obtained blend there is added at least one kind of element selected from the group consisting of copper (Cu), silicon (Si), and zinc (Zn) 0.3 to 1.5% if it is Cu, 0.1 to 0.5% if it is Si, or, 0.1 to 0.5% if it is Zn.

It is to be noted that, in the description of the composition ratio, what is described in terms of "%" represents percentage by weight based on the total weight of the aluminum alloy. And, the other components represents aluminum (Al) and other minute amounts of impurities.

It is known that Mn constituting the alloy component causes the improvement of the high-temperature creep characteristic of the aluminum alloy. Less than 0.1% of Mn cannot obtain a sufficiently high level of effect and if it exceeds 0.9% it cause a decrease in the extrusion workability. Therefore, neither is desirable. A preferable range of the amount of Mn is between 0.5 and 0.9% inclusive. By adding Mn in that range, it is possible to make more difficult for the aluminum alloy to be bent at a high temperature.

Regarding the amount of Mg constituting the alloy component, less than 0.1% of it cannot obtain a sufficiently high level of effect. Addition in excess of 2.0% causes a decrease in the extrusion workability. Therefore,neither is desirable. A more preferable range of Mg is between 0.1 and 1.0% inclusive.

Cu constituting the alloy component acts to enhance the high-temperature creep strength. Addition of less than 0.3% of Cu cannot obtain a sufficiently high level of effect. Addition in excess of 1.5% causes a decrease in the extrusion workability. Therefore, neither is desirable. A more preferable range of Cu is between 0.3 and 1.0% inclusive. It is possible to make the workability and the strength compatible with each other by adding Cu in that range.

Si constituting the alloy component acts to enhance the alloy strength by its addition. Addition of less than 0.1% of Si cannot obtain a sufficiently high level of effect. Addition in excess of 0.5%, on the other hand, causes decrease in the creep characteristic. Therefore, neither is desirable.

Zn constituting the alloy component acts to enhance the alloy strength by its addition. Addition of less than 0.1% of Zn cannot obtain a sufficiently high level of effect. Addition in excess of 0.5%, on the other hand, gives rise to the decrease in the strength. Therefore, neither is desirable.

2) Configuration of the Core Metal

The configuration of the core metal of the heat fixing member according to the present invention will next be described.

In the present invention, it is requisite that the thickness (wall thickness) of the core metal be made 2.8 mm or less, and it is preferable that the lower limit thereof be made 0.5 mm or more. When the thickness of the core metal is less than 0.5 mm, in a state where a nip load is applied, the amount of flexure inconveniently becomes large though it can be said that the core metal is elastically deformed. Therefore, the nip width becomes uneven in the axial direction. As a result, paper wrinkles or image dragging may be generated due to the defects of paper conveyance,and this may cause defects in fixation. On the other hand, when the thickness of the core metal exceeds 2.8 mm, the length of time needed until the core metal reaches a temperature at which fixing is possible becomes great (although this depends upon the other conditions as well it general goes beyond 1 minute). Consequently, the instant startability becomes insufficient. A more preferable range of the thickness of the core metal is between 0.5 mm and 1.7 mm inclusive.

Preferably, the outer diameter of the core metal ranges from 20 to 40 mm inclusive. If the outer diameter is less than 20 mm of permanent deformation is not caused because the material itself in that range has a characteristic of being elastically deformed. However, the amount of flexure thereof due to the nip load becomes large. Therefore, the nip width becomes non-uniform in the axial direction. Therefore, the defects in paper conveyance and thus defects in fixation is caused. Conversely, if the outer diameter is in excess of 40 mm, in the system having provided at the center thereof a heat source such as a heater, an increase in the distance from the surface of the heat fixing member to the heat source is caused. Therefore, the length of time needed until a temperature at which fixing is possible is reached becomes great. Therefore, that range is not preferable. In addition, the greater the outside diameter, the more likely the core metal is to lose its shape. Therefore, when the core metal is a type wherein an elastic layer is formed on the core metal, when forming such an elastic layer, it becomes more likely that the core metal will be caused to become out of shape. Furthermore, if the outer diameter is large, the volume occupied by the heat fixing member in the fixing apparatus will become large, which also leads to the increase in the size of the apparatus itself.

The length of the core metal is not particularly limited. A suitable length conforming the purpose may be suitably selected. Generally, the core metal of 300 mm or more that is longer than the long side of an A4 size is used. On the other hand, in order to fix a larger size of recording material, it is necessary for material having a greater length to be used as the core material. However, in general, the upper limit is to about 450 mm or so.

(Release Layer)

Figure 2:
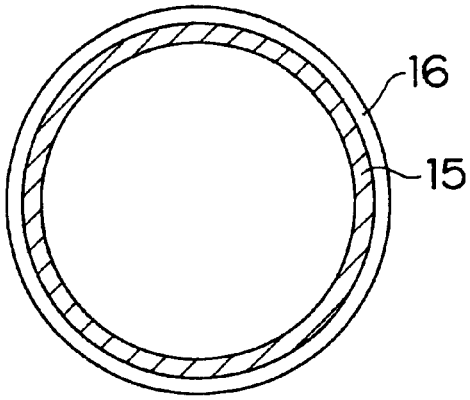
FIG. 2 is a sectional view illustrating a heat fixing member of the present invention in a state where only a release layer alone is formed.

In the heat fixing member of the present invention, a release layer is formed on the above-described core metal. FIG. 2 is a sectional view illustrating the heat fixing member in a state where only a release layer alone is formed. In FIG. 2, on the peripheral surface of a cylindrical core metal 15, a release layer 16 is formed.

As the material of the release layer, a fluorine containing high-molecular material is preferable in terms of the releasing characteristic and heat-resistance. As a conventionally known fluorine containing high-molecular material, fluorine resin such as polytetrafluoroethylene (PTFE), perfluoroalkylvinylether copolymer resin (PFA) or tetra-fluoride ethylene hexa-fluoride propylene copolymer resin (FEP), fluorine rubber, or a material prepared by suitably blending those materials according to the intended purpose, can be cited. Also, for imparting wear resistance, heat conductivity, etc., suitable reinforcing filler, wear-resisting filler, or heat-conducting filler may be blended into the material.

Generally, onto the surface of the release layer, there is supplied oil such as silicone oil for the purpose of assisting the releasing characteristic. Recently, however, in order to facilitate writing on the the recording material having images fixed thereon or pasting of notes thereon, there has been an increasing demand for use of an oil-less fixing system having wax added to the toner, in which no oil at all is used. If the release layer material is applied to such oil-less fixing system, it is preferable to use as the material of the release layer, a fluorine resin such as PFA or PTFE having high-releasing-characteristic.

Although there is a limitation on the thickness of the release layer imposed by means for forming it, a range of from 10 to 100 $\mu$m inclusive is preferable. A release layer having a thickness of less than 10 $\mu$m is likely to cause generation of defects when forming the film through the use of coating technique. In addition, that is likely to cause generate a variation in the film thickness. This may result in fixation unevenness. Further, when a fluorine resin such as PFA is used as the material of the release layer for the purpose of oil-less fixation, wear in it due to the friction of the fluorine resin with the paper is generated. Therefore, considering the service life of the fixing member, if the thickness of the release layer, is less than 10 $\mu$m it may have a shorter life. Conversely, if the thickness of the release layer is more than 100 $\mu$m, a greater length of time is needed for the surface of the heat fixing member to reach a temperature at which fixing is possible. Also, because the film thickness becomes large, the apparent hardness of the surface of the heat fixing member becomes high (that is, becomes hard). Therefore, the deterioration in the quality of the image occurs due to the squeezing of the toner image being crushed. Also, for toner images, such as those of full color images, in which a number of layers have been superimposed, because heat is not uniformly conducted, the degree of fixation decreases and the image quality becomes inferior. The thickness of the release layer is thus most preferably in the range of 10 to 50 $\mu$m.

(Elastic Layer)

Figure 3:
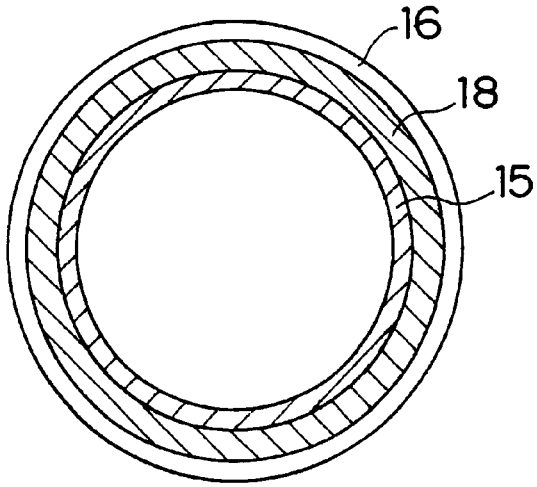
FIG. 3 is a sectional view illustrating the heat fixing member of the present invention in a state where an elastic layer has been formed between a core metal and a release layer that is the outermost layer.

Providing the elastic layer between the core metal and the release layer that is the outermost layer is preferable in respect of being able to further improve the quality of the fixed image. Especially, when fixing a full-color image, the intermediate color is formed by superposing four colors, cyan, yellow, magenta, and black, one over the other. This necessitates elasticity in the heat fixing member itself. It is therefore preferable to provide the elastic layer. Providing the elastic layer makes it possible to add the following various functions which produce a high image quality: The effect of entrapping the toner by the deformation of the elastic layer and thereby conducting heat uniformly; The effect of ensuring the maintenance of the nip width due to the elastic layer being deformed within the nip in the thickness direction; The release effect that is produced at the interface between the toner image and the release layer when the release layer expands due to the deformation of the elastic layer and attempts to be restored to its original position; The toner-release effect that is produced due to the force that is generated when the elastic layer deformed within the nip is released from within the nip zone and then tends to be restored to its original position. FIG. 3 is a sectional view illustrating the heat fixing member of the present invention in a state where the elastic layer has been formed between the core metal and the release layer that is the outermost layer. In FIG. 3, on the peripheral surface of the hollow-circular cylindrical core metal 15, the elastic layer 18 is formed and, the release layer 16 is formed above it.

As the material of the elastic layer, using rubber material such as silicone rubber or fluorine rubber is preferable in the respect of its having elastic durability in a high-temperature region which in the proximity of the fixation temperature. Particularly, because silicone rubber has a relatively low hardness, it is possible to add to it a filler having heat conductivity despite its being rubber. Further, through controlling the cross-linkage density, it is possible to increase the modulus of resilience or the compression set factor. Therefore, the degree of freedom in designing the rubber material also is high. In addition, the rubber material can be formed through the use of relatively inexpensive means such as injection molding. In each of these respects, the use of the rubber material is preferable.

The greater the thickness of the elastic layer, the higher the function as the elastic body. Therefore, there are the merits such as that of ensuring that the nip width can be increased at a low pressure or that of enabling decreasing the surface hardness of the fixing member. However, when consideration is given to the instant startability characteristic, it is preferable to make the thickness 1.0 mm or less. When the thickness of the elastic layer is more than 1.0 mm, the length of time needed until a temperature at which fixing is possible is reached becomes great (it generally exceeds one minute although it depends upon other conditions) Conversely, when the thickness of the elastic layer is less than 50 $\mu$m , its effect as the elastic layer is lost. Consequently, the original effect such as the formation of the nip or the assistance of the releasing characteristic can no longer be obtained. Accordingly, as the thickness of the elastic layer, the range of from 50 $\mu$m to 1.0 mm inclusive is preferable, and the range of from 100 $\mu$m to 0.8 mm inclusive is more preferable.

As the heat conductivity of the elastic layer, when considering the instant startability characteristic, it is preferable to define a range of 0.33 to 0.67 W/m·K [$0.8\times10^{-3}$ to $1.6\times10^{-3}$ cal/(cm·sec·° C.)]. Also, the hardness of the elastic layer, in order for it to exhibit its function as the elastic layer, it is preferable that it has a range of from 1 to 50 degrees inclusive in terms of JIS A hardness.

[Heat and Pressure Fixing Apparatus]

In each of various types of heat and pressure fixing apparatus (hereinafter sometimes referred to simply as "the fixing apparatus") that each use the cylindrical, or, the so-called, heating roll, the heat fixing member of the present invention can be applied as the heating roll. Specifically, by using the heat fixing member as the heating roll in the following fixing apparatus, the function of the present invention can be exhibited. Namely, the fixing apparatus (hereinafter referred to as "the two-roll fixing apparatus" wherein a recording material is inserted into the nip portion between the heating roll and a pressure roll that has been disposed in pressure-contact with and in opposition to it. Or, the fixing apparatus (hereinafter referred to as "the belt fixing apparatus") that uses as a pressure applying member an endless belt instead of the above-described pressure roll. Particularly, when importance is placed upon the instant startability characteristic, it is preferable to apply the heat fixing member of the present invention to the belt fixing apparatus.

Hereinafter, the fixing apparatus using the heat fixing member of the present invention will be described with reference to the drawings.

(Two-Roll Fixing Apparatus)

Figure 4:
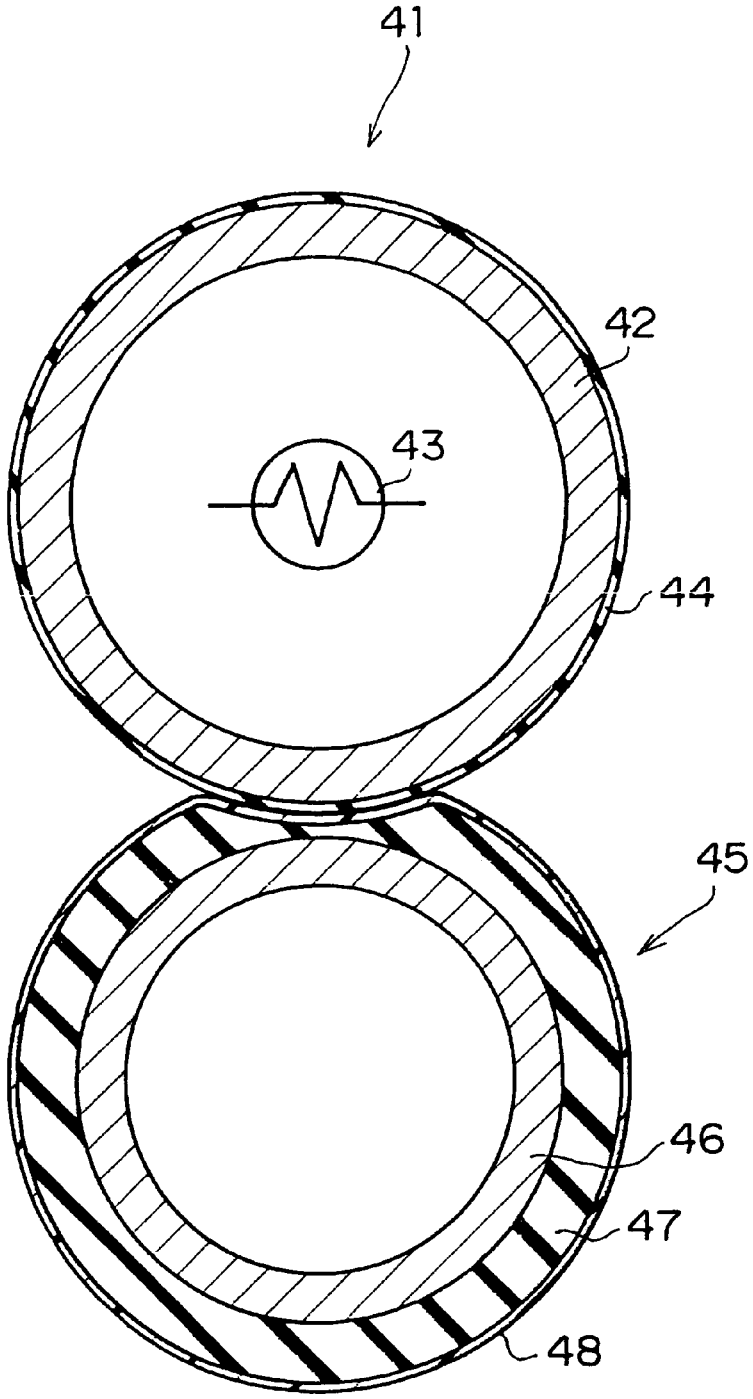
FIG. 4 is a side sectional view illustrating an example of a two-roll fixing apparatus using the heat fixing member of the present invention.

FIG. 4 is a side sectional view illustrating an example of the two-roll fixing apparatus using the heat fixing member of the present invention. The two-roll fixing apparatus illustrated in FIG. 4 is equipped with a heat source 43 inside a cylindrical core metal 42. This two-roll fixing apparatus is constructed of a heating roll (the heat fixing member) having the core metal 42 having formed on its outer peripheral surface a release layer 44 and a pressure roll (the pressure applying member) 45 disposed in pressure contact with the heating roll 41, the pressure roll 45 having formed on its outer peripheral surface of a cylindrical core metal 46 an elastic layer 47 and a release layer 48 made of a heat-resisting resin film or heat-resisting rubber film. In this two-roll fixing apparatus, at a nip portion between the heating roll 41 and the pressure roll 45, there is inserted therethrough a recording material (not illustrated) having unfixed toner image carried thereon. Heating and pressure fixation is thereby performed.

The heat fixing member of the present invention is applied as the heating roll 41 of the two-roll fixing apparatus. It is thereby possible to maintain the image obtained as a high quality image and to realize the instant startability characteristic. Also, even with the long and high-temperature use, the heating roll 41 prevents any inconvenience such as bending from occurring therein. It is to be noted that in this example there has been illustrated as the heating roll 41 the heat fixing member of a type wherein the core metal has no elastic layer on its surface and has only the release layer 128 alone formed thereon. However, of course, the heating roll 41 may be a type wherein an elastic layer is formed between the core metal 42 and the release layer 128.

(Belt Fixing Apparatus)

Figure 5:
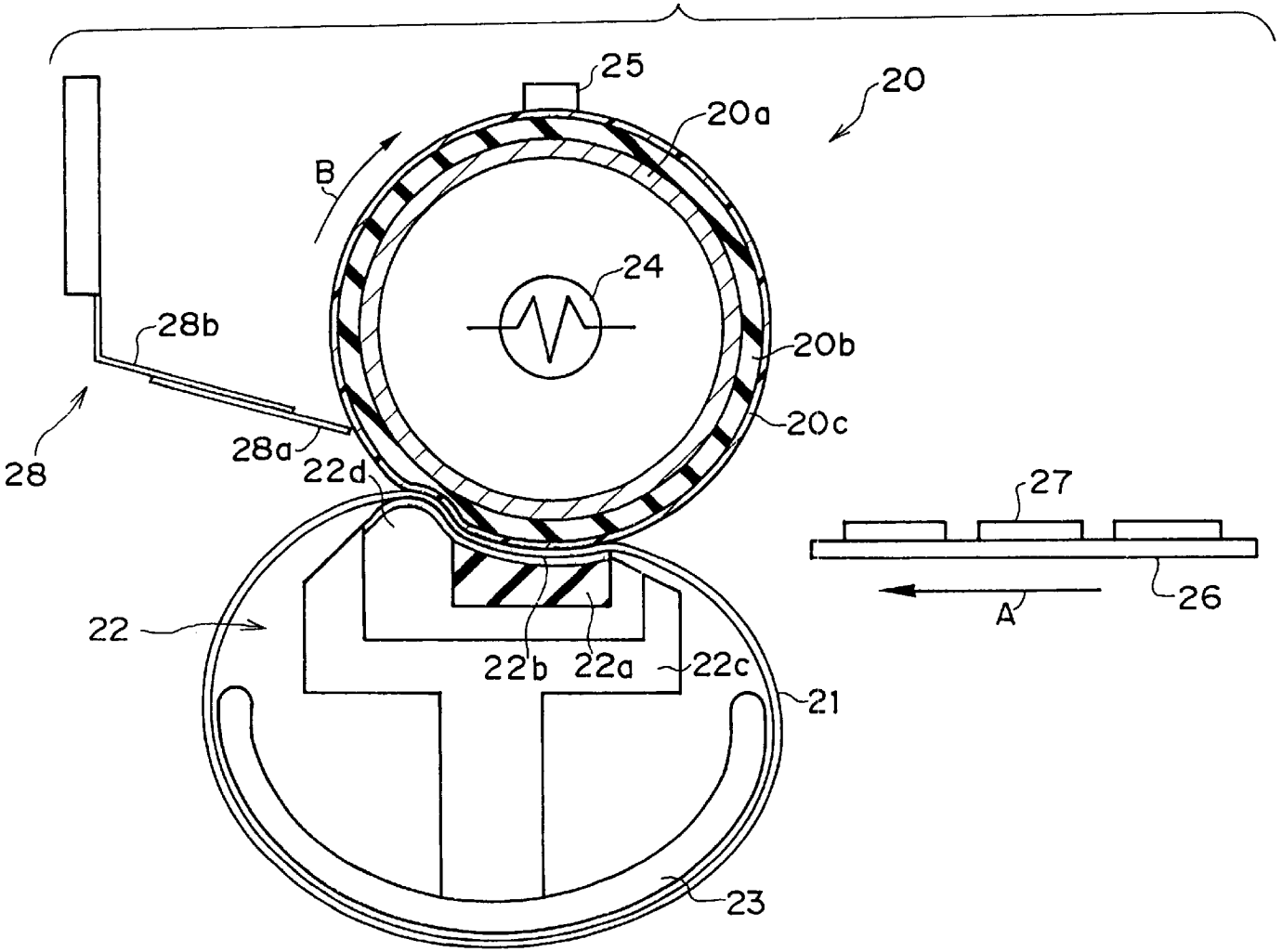
FIG. 5 is a side sectional view illustrating an example of a belt fixing apparatus using the heat fixing member of the present invention.

FIG. 5 is a side sectional view illustrating an example of the belt fixing apparatus that uses the heat fixing member of the present invention. The belt fixing apparatus illustrated in FIG. 5 is constructed of a heating roll (the heat fixing member) 20, an endless belt 21, and a pressure pad (the presser) 22 that is pressed against the heating roll 20 via the endless belt 21.

The heating roll 20 has a cylindrical core metal 20*a* that has formed on its outer peripheral surface an elastic layer 20*b* and a release layer 20*c*. Inside the core metal 20*a*, there is disposed a halogen lamp 24 as a heat source.

The temperature of the surface of the heating roll 20 is measured by a temperature sensor 25. By that measurement signal, the halogen lamp 24 is feedback-controlled through the operation of a temperature control not illustrated so that the surface of the heating roll 20 may be adjusted to a fixed temperature. The endless belt 21 is contacted with the heating roll 20 so that it may be wound around the latter at a prescribed angle, thereby forming a nip portion.

Inside the endless belt 21, the pressure pad 22 is disposed in a state of being pressed to the heating roll 20 via the endless belt 21.

The basic structure of the pressure pad 22 is as follows. Namely, a pre-nip member 22*a* for ensuring a large-width nip portion and an peeling nip member 22*d* for imparting a strain to the heating roll 20 are disposed so that the former may be located at an entrance side of the nip portion and the latter may be located at an exit side thereof. Also, in order to make small the slide resistance between the inner peripheral surface of the endless belt 21 and the pressure pad 22, a low-friction layer 22*b* is disposed at the surface of the pre-nip member 22*a* with the endless belt 21 of the peeling nip member 22*d*. These elements are retained as they are by means of a holder 22*c* made of metal. The pre-nip member 22*a* is substantially formed into a concave configuration in accordance with the outer peripheral surface of the heating roll 20. The pre-nip member 22*a* is pressed against the heating roll 20 to thereby form the nip portion and thereby cause the production of a prescribed amount of strain in the heating roll 20. Further, a belt travel guide 23 is attached to the holder 22*c* so that the endless belt 21 may make a smooth slide rotation. The belt travel guide 23 preferably is made of material the friction coefficient of which is low since friction is caused with the inner surface of the endless belt 21. In addition, the belt travel guide 23 preferably is made of a material the heat conductivity of which is low so as to make it difficult for the endless belt 21 of heat.

The heating roll 20 is rotated in a direction indicated by arrow B by a motor not illustrated. By this rotation, the endless belt 21 makes its driving rotation, too.

A toner image 27 is transferred onto a recording material 26 through the operation of a transfer device not illustrated. This recording material 26 is conveyed on from the right side of the illustration towards the nip portion (in a direction indicated by arrow A). The toner image 27 on the recording material 26 that has been inserted through the nip portion is fixed by the pressure acting on the nip portion and the heat that is supplied from the halogen lamp 24 through the heating roll 20. If performing fixation by the use of the fixing apparatus the structure of which is illustrated in FIG. 5, the nip portion can be made wide. It is therefore possible to ensure a stable level of fixing performance.

Also, in the belt fixing apparatus of this example, the wide nip portion is ensured by the pre-nip member 22*a* that is made substantially concave so as to follow the outer peripheral surface of the heating roll 20. Simultaneously, an peeling nip member 22*d* is made to protrude towards the configuration of the outer peripheral surface of the heating roll 20. And, due to that peeling nip member 22*d,* in the vicinity of the exit of the nip portion (hereinafter the exit and its vicinity may be referred to as "the peeling nip portion"), the strain of the heating roll 20 be made large locally. By making the strain of the heating roll large locally, a high level of release performance can be obtained with a small amount of strain compared to a case where, as in the fixing technique using a roll pair, strain is caused to occur over the whole nip zone. Accordingly, even when using a thin-film heat-resisting resin layer, the occurrence of wrinkles can be prevented. In addition, the problem such as peeling between the heat-resisting elastic layer and the release layer based on the use of the heat-resisting resin also is unlikely to occur. Therefore, the maintenance of the release performance is obtained along with the long-term reliability.

Furthermore, because the heating roll 20 only needs to have a small amount of strain, it is possible to make thin the elastic layer of the heating roll 20. This contributes to decreasing the heat capacity of the heating roll 20 and therefore the instant startability characteristic is more enhanced. At the same time, it is also possible to decrease the power consumption. In addition, because the elastic layer having poor heat conductivity can be made thin, the heat resistance between the inner surface and the outer surface of the heating roll can be made low. As a result, the thermal response is quickened. Accordingly, a higher speed of fixation becomes possible.

The recording material 26 after fixing the toner is excellently peeled due to both the effect of the release layer 20*c* and the strain at the nip portion, without being wound onto the heating roll 20. However, in this case, it is preferable that, as means for assisting the peeling, peeling means 28 be provided at a downstream side of the nip portion as viewed in the rotation direction of the heating roll 20. The peeling means 28 is constructed in such a way as to be kept retained by a guide 28*b* in a state of being in contact with the heating roll 20 in an opposite direction (reverse direction) to the rotation direction of the heating roll 20.

The constituent elements will be described below in detail.

As the heating roll 20, the heat fixing member of the present invention is used. As a result of using the heat fixing member of the present invention as the heating roll 20, the effect such as the instant startability characteristic resulting from the present belt fixing apparatus is realized at a higher dimension. It is to be noted that in this example the heat fixing member of an aspect in which the elastic layer and the release layer are sequentially formed on the surface of the core surface has been illustrated as the heating roll 20. However, of course, the heating roll 20 may be also a type having no elastic layer therein and having only the release layer alone formed therein.

The endless belt 21 preferably is constructed of a base layer and a release layer which is coated on the surface (the surface in contact with the heating roll 20, or, each surface of the base layer) thereof. The base layer is selected from polyimide, polyamide, or polyamide imide and the thickness thereof preferably is from 50 to 125 $\mu$m or so and, more preferably, from 75 to 100 $\mu$m or so. As the release layer formed on the surface of the base layer a type prepared by the above-described fluorine resin, for example, PFA or the like, having been coated on the base layer to a thickness of from 5 to 20 $\mu$m is preferable.

The winding angle through which the endless belt 21 is wound onto the heating roll 20, is preferably from approximately 20 to 45 degrees so as to ensure that the nip portion sufficiently wide, although it may vary depending upon the rotation speed of the heating roll 20, Also, it is preferable to set the winding angle such that the duration time (the time the recording material is inserted through) of the nip portion be 30 msec. or more, and particularly from 50 to 70 msec. or so.

By using the endless belt 21 capable of being driven in accordance with configuration of the heating roll 20 in that way, it is possible to largely take the width of the nip portion, thereby it is possible to enhance the fixability characteristic of the toner and the releasing characteristic.

The pressure pad 22 is constructed, as stated before, of the pre-nip member 22*a,* the low-friction layer 22*b,* the peeling nip member 22*d,* and the holder 22*c.*

The pre-nip member 22*a* can use an elastic body such as that described in connection with the elastic layer of the heat fixing member, a plate spring, etc. The pre-nip member 22*a* is formed into a concave configuration substantially following the outer peripheral surface of the heating roll 20. Further, the low-friction layer 22*b* formed on the pre-nip member 22*a* is provided for the purpose of making small the slide resistance between the inner peripheral surface of the endless belt 21 and the pressure pad 22. Therefore, the low-friction layer 22*b* preferably has a small friction coefficient and has high wear resistance. Specifically, it is possible to use a glass fiber sheet having Teflon impregnated therein, a fluorine resin sheet, or resin such as that described in connection with the release layer of the heat fixing member.

The above-described pressure pad 22 is pressed against the heating roll 22 to thereby form the nip portion, thereby causing the production of a prescribed amount of strain in the heating roll 20. The total load of the pressure pad 22 is not particularly limited if within a range in which a desired amount of strain is obtained. However, the fixing apparatus of the present invention has a wide nip portion. Therefore, if the load is caused to gradually become greater from the entrance towards the exit of the nip portion, even a lesser magnitude of total load would be give a sufficiently large amount of strain.

Here, the word "strain" refer to the following. Namely, when the pressure pad 22 is pressure contacted with the heating roll 20 via the endless belt, the elastic layer 20*b* and release layer 20*c* on the surface of the heating roll 20 are elastically deformed and at this moment a strain occurs in the surfaces thereof. The word "strain" refers to that strain.

The pressure pad 22 is disposed in a state that is fixed and is not rotated as in the case of a roll. Therefore, the heat that is conducted from the heating roll 20 is difficult to dissipate. Therefore, even when the heating roll 20 starts to rotate and then the endless belt 21 is driven-rotated, because the endless belt 21 is thin and is small in capacity, the amount of heat that is transferred from the heating roll 20 is small. The belt fixing apparatus of this example thus has a small heat loss. Therefore, the heating roll 20 is less decreased and it is thus economical.

The belt transport guide 23 is in slide contact with the inner surface of the endless belt 21. Therefore, the belt transport guide 23, preferably has a member whose friction coefficient is low and, in addition, a member whose the heat conductivity is low so as to make heat transfer from the belt difficult, is preferable. As such a member, there can be used heat-resisting resin such as PFA or PPS, etc.

As described above, according to the belt fixing apparatus of this example, a high level of releasing performance can be obtained without using a releasant (oil). Of course, oil may be used in order to obtain a yet higher level of releasing performance.

However, in a full-color copier, because the toners of the four colors yellow, magenta, cyan and black respectively are used, a large amount of toner is transferred onto the recording material. Therefore, when peeling it off at the exit of the nip portion, a peeling force having a high magnitude. If the recording material is relatively high in toughness as in the case of a J-paper made by Fuji Xerox Company Limited (having a basic weight of 80 g/m$^2$), it can be self-stripped through the use of a material having high toughness. However, in case there is a large amount of toner, or a material the toughness which is weak such as an S-paper made by Fuji Xerox Company Limited (having a basic weight of 56 g/m$^2$) or a tracing paper has been used as the recording material, it becomes difficult to peel it off. Therefore, it is likely that the recording material becomes wound onto the heating roll 20. At this time, when a plurality of peeling fingers which are widely used in a conventional white/black fixing apparatus is used, a local force acts on the recording material. As a result, it is likely that the toner image will be scratched by the peeling finger with the result that image defects occur. In addition, through a long-term use, it is also likely that the surface of the heating roll 20 is locally clawed with the result that the service life of the heating roll 20 shortens.

On that account, in the fixing apparatus of this example, in view of problems of the conventional device, peeling means 28 preferably is provided as auxiliary means for assisting the peeling of the recording material. The peeling means 28 is constructed as follows. Namely, the peeling means 28 is located at a position downstream of the nip portion that has been viewed in the rotation direction (the arrow B direction) of the heating roll 20. And, an peeling sheet 28*a* is retained by a guide 28*b* in a state of being contacted with the heating roll 20 in an opposite (reverse) direction to the rotation direction of the heating roll 20. It is to be noted that the word "contact" referred to there includes not only a state where only a forward end alone of the peeling sheet 28*a* is contacted with the heating roll 20. But it also includes a state where the forward end and the portion in the vicinity thereof are plane-contacted therewith. It further includes a state where only the portion alone in the vicinity of the forward end is plane-contacted therewith whereby the forward end is slightly lifted up.

As the peeling sheet 28*a,* a heat-resisting plastic sheet such as polyimide resin, polyamide resin, or polyamide imide resin, or, a metal thin plate made of iron or stainless steel can be used. The thickness of the peeling sheet 28*a* varies depending upon a material that is used therefor. However, when polyimide resin is used the thickness preferably ranges from 50 to 150 $\mu$m or so. A thickness of less than 50 $\mu$m may not impart a pressure-contact force for ensuring the peeling force. On the other hand, a thickness of more than 150 $\mu$m causes the recording material to be peeled to protrude on to the front end of the peeling sheet 28*a*. So it is likely that peel-off cannot be smoothly done. Therefore, neither case is desirable. Also, the peeling sheet 28*a* may have its surface covered with a fluorine resin such as a PFA film. By covering it with a fluorine resin, it is possible to prolong the service life of the peeling sheet 28*a* owing to the hardness of that resin.

The peeling sheet 28*a* has a contact width the length of which is substantially the same as the axial length of the heating roll 20. By making the peeling sheet 28*a* large in width, because the recording material is supported over the entire region in the width direction of the peeling sheet 28*a,* the pressure per unit area acting on the recording material becomes low. This prevents the toner image from being scratched. Accordingly, even if the peeling sheet 28*a* rubs the surface of the toner image in a molten state immediately after fixation, no damages are caused to the image. It is to be noted that the expression "the length of which is substantially the same as the axial length of the heating roll 20" referred to in the present invention indicates the length that would approximately enable the above-described effect to be obtained. It is actually a concept that includes up to the length that is approximately half the axial length of the heating roll 20. However, in order to attain the following objects, it is preferable that the peeling sheet 28*a* at least has a width that covers the entire region of the inserted-paper width of the recording material. Namely, the object eliminating the difference in state of image portion which in contact with the peeling sheet 28*a* the portion which is not in contact with the peeling sheet 28*a;* the object eliminating the unevenness of the fixation due to the difference in deterioration between the portion of contact of the heating roll 20 with the recording material and the portion which does not contact the recording material; and the object of thereby attaining the above-described effects at a high level.

The peeling sheet 28*a* needs to be pressure-contacted with the heating roll 20 by a force which when pressure contacted with the heating roll 20 eliminates undulation occurring due to the front end and/or, the portion in the vicinity thereof, of the peeling sheet 28*a,* being heated. Although the pressure contact force at that time is different depending upon the material used, that force is to about from 100 to 500 g or so when polyimide resin having a width of is 300 mm used.

The peeling sheet 28*a* is attached to the guide 28*b* in a state in which it protrudes from a forward end of the guide 28*b* by a certain length. By making the length of such protrusion relatively short, there is ensured a rigidity capable of resisting the toner-sheet peeling force despite its being thin. The preferable length of the protrusion is from 2 to 5 mm or so when, for example, polyimide resin is used, although it is different depending upon the material used.

The angle that is defined by a tangential line with the heating roll 20 at a point of contact between itself and the peeling sheet 28*a,* and the peeling sheet 28*a,* preferably is from 20 to 50 degrees or so, or, more preferably, from 30 to 40 degrees or so. If this angle is more than 50 degrees it becomes difficult to ensure the above-described pressure-contact force. On the other hand, if it is less than 20 degrees, when peeling is done the recording material protrudes onto a side surface of the peeling sheet 28*a.* This may make smooth peeling impossible. Thus angles outside the above range are not preferable.

The guide 28*b* holds the peeling sheet 28*a* and is fixed to a frame of the fixing apparatus. So a prescribed magnitude of rigidity is needed for the guide 28*b* and, as the material therefor, various kinds of metal, plastics, etc. can be used.

Figure 6:
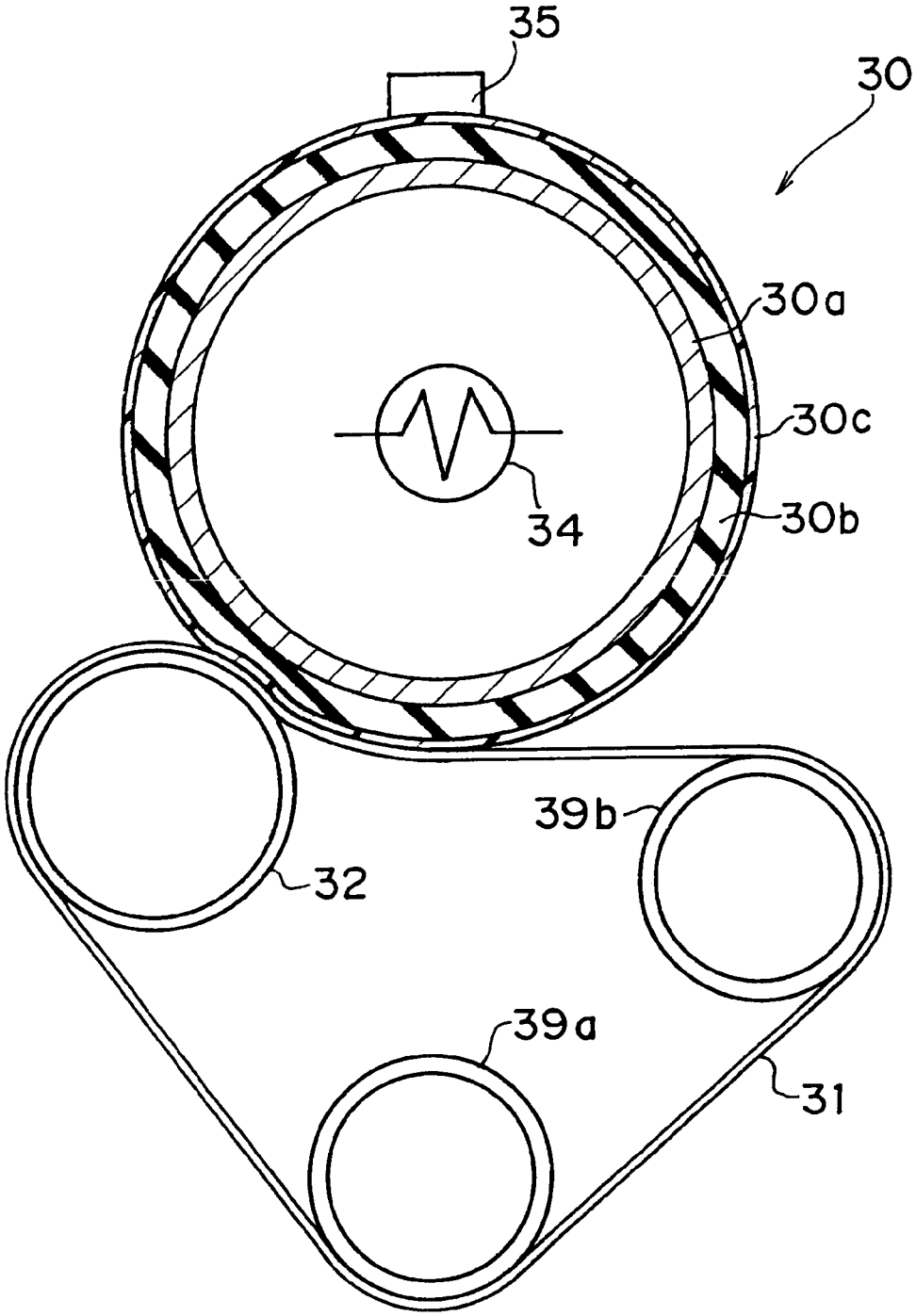
FIG. 6 is a side sectional view illustrating another example of the belt fixing apparatus using the heat fixing member of the present invention.

FIG. 6 is a side sectional view illustrating another example of the belt fixing apparatus that uses the heat fixing member of the present invention. The belt fixing apparatus illustrated in FIG. 6 is the same as the belt fixing apparatus illustrated in FIG. 5 in respect of the structures of a heating roll (heat fixing member) 30 and endless belt 31. However, in this example, the former apparatus is different from the latter apparatus in respect of the structure of the pressure applying member and in that the endless belt 31 is tensioned by three rolls which are a pressure roll 32 and tension rolls 39*a,* 39*b.* This structure is disclosed in JP-A No. 5-150679.

The endless belt 31 is wound around the heating roll 30 through a prescribed winding angle as in the case of the belt fixing apparatus illustrated in FIG. 5 to thereby form a nip portion. However, at an exit of that nip portion, the pressure roll 32 is pressed against the heating roll 30 to thereby cause the production of strain in the elastic layer 30*b* of the heating roll 30. By this structure, as in the case of the belt fixing apparatus illustrated in FIG. 5, a wide nip portion is ensured, whereby, at the vicinity of the exit, of the nip portion, the strain of the heating roll 30 locally enlarged. And, the effects resulting therefrom also are the same as in the case of the belt fixing apparatus illustrated in FIG. 5. Also, in this example, it is possible to make the amount of strain of the heating roll 30 at the exit, vicinity of the nip portion relatively large (3% or so). If the amount of strain is made large in that way, self-stripping becomes possible. As a result, it becomes unnecessary to provide the peeling means 28 in the belt fixing apparatus illustrated in FIG. 5.

With regards to the pressing force of the pressure roll 32, compared to the pressure roll (the pressure roll 45 in FIG. 4) in the previously mentioned two-roll fixing apparatus, it is possible to make the diameter of the pressure roll 32 small. Therefore, it is possible to obtain a peeling force a sufficiently high magnitude with a lesser pressing force and a lesser amount of strain.

The belt fixing apparatus have each been described above with the use of a corresponding one of FIGS. 5 and 6. The greatest merit of each of these belt fixing apparatus is that enhancement of the instant startability characteristic, increase in the quality of image, and increase in the speed of the fixation can be achieved. Particularly, in order to make the instant startability characteristic even more effective, it is useful to apply the heat fixing member of the present invention to the above-described belt fixing apparatus. By using this, it is possible to further shorten the preparation period and it becomes possible to enhance the reliability as the fixing member.

Namely, the instant startability characteristic that is attainable with the use of the heat fixing member of the present invention is most effectively exhibited by the belt fixing apparatus the. In the case of the belt fixing apparatus, wherein the endless belt used in place of the pressure roll in the two-roll fixing apparatus is wound around the heat fixing member through a prescribed angle, the heat fixing member is pressed by the pressure applying member inside the endless belt; and the recording material such as recording paper is inserted through the nip portion between the heat fixing member and the endless belt to thereby perform fixation. In this case a high quality of image and the instant startability characteristic can be both achieved at a high level.

Incidentally, with regards to the above-described belt fixing apparatus, in either one of the examples of FIGS. 5 and 6, as the heating rolls 20, 30, there has been illustrated the heat fixing member of a type having formed therein the elastic layer 20*b,* 30*b* between the core metal 20*a,* 30*a* and the release layer 20*c,* 30*c.* However, no elastic layer 20*b,* 30*b* need not be disposed on the surface of the core metal 20*a,* 30*a,* on which only the release layer 20*c,* 30*c* may be formed. Of course, the types of FIGS. 5 and 6 having the elastic layer 20*b,* 30*b* is more preferable from the viewpoint of the effect of the quality of image obtained becomes enhanced, the effect that the recording material, etc.

The fixing apparatus using the heat fixing member of the present invention has been described above by taking as examples the two-roll fixing apparatus illustrated in FIG. 4 and the belt fixing apparatus of FIGS. 5 and 6. However, the heat fixing member of the present invention is not limited thereto and can be applied to various other types of heat fixing apparatus.

In the fixing apparatus using the heat fixing member of the present invention, it is preferable that the recording material is heated and pressurized, in a state where the heat fixing member is heated at a temperature of 100 to 210° C. and a load has been applied thereto by the pressure applying member so that a stress of 60.0 MPa or less. Namely, by operating the fixing apparatus in the region within which the heat fixing member is elastically deformed, that apparatus attains excellent instant startability characteristic and excellent durability while maintaining a high quality of the obtained image.

The temperature of the heat fixing member, is preferably 210° C. But, in order to attain the above-described effect at a high level, it is more preferable that that temperature be set to 200° C. or less. Furthermore, when consideration is given to the original purpose for which the heat and pressure fixing apparatus was intended, it is necessary that toner be sufficiently molten. For this reason, the temperature of the heat fixing member preferably is set to be 100° C. or more and, more preferably, is set to be 120° C. or more.

On the other hand, as the load applied to the heat fixing member, it is preferable that that load is such that a stress of 60.0 MPa or less be produced. But, in order to attain the above-described effect at a high-dimensional level, it is more preferable that that load is such that a stress of 55.0 MPa or less be produced. Further, it is again more preferable that that load in such that a stress of 50.0 MPa or less be produced.

Incidentally, in the heat and pressure fixing apparatus, it is preferable to use the heat fixing member of the present invention that is defined in such a way that elastic deformation is obtained at 210° C. But it is sufficient to use a heat fixing member in which elastic deformation is generated at least at a temperature prevailing at the time of fixation. Namely, in the following state, it is preferable that the heat fixing member be elastically deformed. The state in which the heat fixing member is one wherein at least the release layer is formed on the outer peripheral surface of the core metal; the thickness of the core metal is 2.8 mm or less; and at the time of the fixation, a load is applied to the heat fixing member of the pressure applying member pressure-contacted with the outer peripheral surface thereof to thereby form the nip portion so that a stress of 60.0 MPa or less may be generated therein.

Also, the load applied to the heat fixing member by the pressure applying member, is preferably a load that causes the production of a stress of 25.0 MPa or more. A stress less than 25.0 MPa results in the thickness of the heat fixing member becoming large. As a result, it takes a long time to heat that member up to a temperature at which fixing is possible. As a result, the instant startability characteristic becomes insufficient. Further, as a result, the pressure applied to the nip portion becomes short. This leads to defective fixation of the image, defective melting of the unfixed toner, and hence degradation of the image quality.

[Image Formation Apparatus]

The above-constructed heat and pressure fixing apparatus can be used as the fixing apparatus for an image formation apparatus of a conventionally known electro-photography system. Namely, in the image formation apparatus comprising electrostatic latent image formation means for forming an electrostatic latent image on an electrostatic latent image carrier body, development means for developing that electrostatic latent image through the use of toner, transfer means for transferring the obtained toner image onto a recording sheet, and fixation means for fixing the thus-transferred toner image on the recording sheet, the above-constructed heat and pressure fixing apparatus can be used as the fixation means. Through the use thereof, it is possible to provide an image formation apparatus capable of achieving enhancement in the quality of image, the prolongation of the service life, the decrease in the energy used and the increase in speed.

Incidentally, except for the fixation means, the any conventional device can be used in the present invention as long as it does not runs counter to the intended purpose of the present invention.

DESCRIPTION OF THE PREFERRED EMBODIMENTS

[Embodiments]

The present invention will now be explained in detail by describing relevant examples.

EXAMPLE NO. 1

(1) Manufacture of Core Metal A

As the material of the core metal, there was used an alloy (a) that is an Mn-based Al alloy of the following alloy composition.

(Composition of the Alloy (a))

Mn: 0.9%/ Mg: 2.0%/ Cu: 1.5%/ Si: 0.5%/ Zn: 0.5%/ Al and a small amount of other components: the remaining components Using the alloy (a) there was manufactured a hollow-pipe-like core metal A having an external diameter of 25 mm in outside diameter, an internal diameter of 23 mm, a thickness of 1 mm, and 340 mm in length.

The elastic-deformation index of the thus-obtained core metal A was measured, by using the measuring apparatus illustrated in FIG. 1 (specifically the Instron-made digital static material testing machine model 5507 manufactured by Instron and there was used as the strain gauge 6, a 2-mm-length strain gauge manufactured by Kyodo Dengyo Limited). At this time, the fulcrum 8, 8' were disposed at positions 20 mm away from both ends of the core metal A (the measured sample 12), respectively. Then, within the high-temperature chamber 14 maintained at 210° C. the rod portion 2*b* of the crosshead 4 was pressed down 0.5 mm/min. in the direction indicated by arrow-A. Then, a load of approximately 343 N (35 kgf) was applied to the center of the outer peripheral surface of the core metal A and the stress which was received by a portion on a side opposite to that having a portion where the load was applied was 60.0 MPa. Thereafter, the load was removed. Determination was then made of the elastic-deformation index e from the residual amount of strain obtained by the strain gauge 6. As a result, the elastic-deformation index $\epsilon$ was $30\times10^{-6}$, whereby it was confirmed that the core metal A exhibited elastic deformation. Namely, it was confirmed that the core metal A had a high-temperature elasticity characteristic.

(2) Manufacture of the Heating Roll A

On the peripheral surface of the thus-obtained core metal A (the core metal that was used for measuring the elastic-deformation index $\epsilon$ is only used for measurement. For manufacturing the heating roll the core metal made of the same material and having the same configuration as that of that core metal is used. In the following Examples and Comparative Examples, the same applies) the elastic layer was formed to a thickness of 1 mm as by using the following heat-conductive silicone rubber. The silicone rubber has a heat conductivity of 0.59 W/m·K [$1.4\times10^{-3}$ cal/(cm. sec. ° C.)] and a JIS A hardness of 40 degrees. Further, on that elastic layer, as the release layer, a PFA tube 30 $\mu$m in thickness was integrally formed to thereby form a heating roll (a heat pressure applying member) A.

(3) Evaluation by the Fixing Apparatus

The thus-obtained heating roll A was assembled into an evaluation bench (a fixing apparatus for use for the characteristic evaluation) for the two-roll fixing apparatus of the structure illustrated in FIG. 4 (provided, that the elastic layer is provided between the core metal 42 and the release layer 44). Evaluation was thereby made of the characteristic of the heating roll A.

As the pressure roll 45 serving as the pressure applying member, there was manufactured a type having an iron-made core metal provided therein and having provided on that core metal a 2 mm thick elastic layer made of silicone rubber whose hardness is 30 degrees by JIS standards and having an outer diameter of 30 mm. On the other hand, the heating roll 41 is pressed by the pressure roll 45 under a nip pressure of 391 N (40 kgf). (At this time the stress that was received by the heating roll 41 was 35 MPa). Then heat is supplied by the heating source 43 to the heating roll 41 so that the surface thereof may become 200° C. Then the resulting heating roll 41 was left as was for 5 hours. Thereafter, the amount of deformation of the heating roll 41 was measured by scale deflection. The deflection was found to be 0.1 mm or less. Also, then, 10 sheets of entire-area-solid full color image were subjected to fixation on an A4 size recording material As a result, no paper wrinkles were generated and uneven fixation did not occur. Further, the time length that was needed until the surface of the heating roll 41 reached a toner-temperature at which fixing is possible (200° C.) from normal temperature (hereinafter referred to as "the warm-up time") was 29 seconds. Each of those results is summarized in Table 1 below.

EXAMPLE NO. 2

(1) Manufacture of the Core Metal B

Using the alloy (a) that was used in Example No. 1, a core metal B was manufactured that is shaped like a hollow pipe and whose external diameter 30 mm, 29 mm internal diameter is, thickness is 0.5 mm , and which is 340 mm in length.

The elastic-deformation index $\epsilon$ of the thus-obtained core metal B was measured in the same way as in Example No.1. However, at this time, the load that was applied to the center of the peripheral surface of the core metal B was approximately 265 N (27 kgf). The stress received by the core metal at a position on a side opposite to that from which that load had been applied thereto was 60.0 MPa.

The elastic-deformation index $\epsilon$ that was determined was $35\times10^{-6}$, and it was confirmed that the core metal B exhibited elastic deformation. As a result, it was confirmed that the core metal B had a high-temperature elasticity characteristic.

(2) Manufacture of the Heating Roll B

In Example No. 2, there was manufactured a heating roll (the heating and pressure applying member) B was manufactured in the same way as in Example No. 1 except that a core metal B was used as the core metal in place of the core metal A.

(3) Evaluation by the Fixing Apparatus

The characteristic of the heating roll B were evaluated in the same way as in Example No. 1. The stress that the heating roll 41 received in the evaluation bench was 45 MPa. As a result of the characteristic evaluation, the scale deflection was 0.1 mm or less and, even in the fixation of the whole-area-solid full color image, no wrinkles nor fixation unevenness occurred. Also, the warm-up time was 23 seconds. Each of those results is summarized in Table 1 below.

EXAMPLE NO. 3

(1) Manufacture of the Core Metal C

Using the alloy (a) that was used in Example No. 1, Core metal C was manufactured which that was shaped like a hollow pipe and that was 40 mm in outside diameter, 39 mm in inner diameter, 0.5 mm in thickness, and 340 mm in length.

The elastic-deformation index $\epsilon$ of the core metal C thus obtained, was measured in the same way as in Example No. 1. At this time, however, the load that had been applied to the center of the peripheral surface of the core metal C was approximately 480 N (49 kgf). The stress the core metal C received at a portion on a side opposite to that having a portion at which that load had been applied was 60.0 MPa.

The thus-determined elastic-deformation index $\epsilon$ was $33\times10^{-6}$, whereby it was confirmed that elastic deformation was exhibited and it was also confirmed that the core metal C had a high-temperature elasticity characteristic.

(2) Manufacture of the Heating Roll C

On the peripheral surface of the thus-obtained core metal C, as the release layer, a PFA coating film the thickness of which was 30 $\mu$m was formed by powder electrostatic coating to thereby manufacture the heating roll (the heating and pressure applying member) C.

(3) Evaluation by the Fixing Apparatus

The characteristic of the thus-obtained heating roll C was evaluated in the same way as in Example No. 1. However, in this case the nip pressure in the evaluation bench was 588 N (60 kgf) and the stress the heating roll 41 received was 36 MPa. Further, the fixed image was made to be a black and white image. The result of the characteristic evaluation was that the scale deflection was 0.1 mm or less; and even at the time of the fixation of the whole-area-solid black/white image no paper wrinkles and fixation unevenness occurred. Also, the warm-up time was 24 seconds. Each of those results is shown in Table 1 below.

EXAMPLE NO. 4

(1) Manufacture of the Core Metal D

Using the alloy (a) that was used in Example No. 1, there was manufactured a core metal D shaped like a hollow pipe, the outside diameter, inner diameter, thickness, and length of which were 22 mm, 16 mm, 2.8 mm, and 340 mm, respectively.

The elastic-deformation index $\epsilon$ the core metal C thus obtained, was measured in the same way as in Example No. 1. At this time, however, the load that had been applied to the center of the peripheral surface of the core metal C was approximately 588 N (60 kgf) and the stress the core metal D received at a portion on a side opposite to that having a portion at which that load was applied was 60.0 MPa.

The thus-determined elastic-deformation index $\epsilon$ was $20\times10^{-6}$, whereby it was confirmed that elastic deformation was exhibited and it was also confirmed that the core metal D had a high-temperature elasticity characteristic.

(2) Manufacture of the Heating Roll D

In Example No. 4, The heating roll (the heating and pressure applying member) D was manufactured in the same way as in Example No. 1, except that the core metal D was used in place of the core metal C.

(3) Evaluation by the Fixing Apparatus

As regards the thus-obtained heating roll C, the characteristic was evaluated in the same way as in Example No. 1. However, that in this case the nip pressure in the evaluation bench was 588 N (60 kgf) and the stress the heating roll 41 received was 30 MPa. Further, the fixed image was a black and white image. The result of the characteristic evaluation was that the scale deflection was 0.1 mm or less;

and even at the time of the fixation of the whole-area-solid black/white image no paper wrinkles nor fixation unevenness occurred. Also, the warm-up time was 32 seconds. Each of those results is shown in Table 1 below.

EXAMPLE NO. 5

(1) Manufacture of the Core Metal E

Using the alloy (a) that was used in Example No. 1, there was manufactured a core metal E shaped like a hollow pipe, the outside diameter, inner diameter, thickness, and length of which were 35 mm, 33.4 mm, 0.8 mm, and 340 mm, respectively.

The elastic-deformation index $\epsilon$ the core metal E thus obtained was measured in the same way as in Example No. 1. At this time, however, the load that had been applied to the center of the peripheral surface of the core metal E was approximately 568 N (58 kgf) and the stress the core metal E received at a portion on a side opposite to that having a portion at which that load was applied was 60.0 MPa.

The thus-determined elastic-deformation index $\epsilon$ was $29\times10^{-6}$, whereby it was confirmed that elastic deformation was exhibited and it was also confirmed that the core metal E had a high-temperature elasticity characteristic.

(2) Manufacture of the Heating Roll E

On the peripheral surface of the thus-obtained core metal E the elastic layer was formed to a thickness of 1 mm the elastic layer by using a heat-conductive silicone rubber having a heat conductivity of 0.46 W/m·K [$1.1\times10^{-3}$ cal/(cm. sec. ° C.)] and a JIS A hardness of 30 degrees. Further, on that elastic layer, as the release layer, a PFA tube 30 $\mu$m in thickness was integrally formed to thereby form a heating roll (the heating/pressure applying member) E.

(3) Evaluation by the Fixing Apparatus

The thus-obtained heating roll E was assembled into an evaluation bench (a fixing apparatus for use for the characteristic evaluation) of the belt fixing apparatus having the structure illustrated in FIG. 5. Evaluation was thereby made of the characteristic of the heating roll E.

As the endless belt 21, there was used a type wherein a release layer 50 μm thick was formed through PFA dispersion, on the surface of a polyimide material (80 μm thick) that was heat-resisting resin. Also, the pressure pad 22 consists of two separate members one of which is the pre-nip member 22*a* on the entrance side of the nip and the other of that is the peeling nip member 22*d* on the exit side. The pre-nip member 22*a* is formed of silicone rubber the hardness of which is JIS A hardness of 20 degrees, while the peeling nip member 22*d* consists of an aluminum alloy pad.

In the above-described belt fixing apparatus, the heating roll 20 is pressed by the pressure pad 22 under a nip pressure of 441 n (45 kgf) via the endless belt 21. (At this time the stress that was received by the heating roll 20 was 25 MPa). Then heat is supplied by the halogen lamp 24 to the heating roll 20 so that the surface thereof was 200° C. Then the heating roll 20 was left as was for 5 hours. Thereafter, the amount of deformation of the heating roll 20 was measured by scale deflection. The deflection was 0.1 mm or less. Also, then, 10 sheets of whole-area-solid full color image were subjected to fixation on an A-4 size recording material. Further, the warm-up time was 30 seconds.

EXAMPLE NO. 6

(1) Manufacture of the Core Metal F

As the material of the core metal, there was used an alloy (b) that is an Mn-based Al alloy of the following alloy composition.

(Composition of the Alloy (b))

Mn: 0.5%/ Mg: 0.1%/ Cu: 0.3%/ Si: 0.5%/ Zn: 0.5%/ Al and a small amount of other components: the remaining components Using the alloy (b) a hollow-pipe-like core metal F 30 mm having an outside diameter of 30 mm, inner diameter of 27.6 mm, a thickness of 1.2 mm, and a length of 340 mm was manufactured.

The elastic-deformation index ϵ of the core metal F thus obtained was measured in the same way as in Example No. 1. At this time, however, the load that was applied to the center of the peripheral surface of the core metal E was approximately 588 N (60 kgf). and the stress the core metal F received at a portion on a side opposite to that having a portion at which that load had been applied was 60.0 MPa.

The thus-determined elastic-deformation index ϵ was $24\times10^{-6}$, whereby it was confirmed that elastic deformation was exhibited and it was also confirmed that the core metal F had a high-temperature elasticity characteristic.

(2) Manufacture of the Heating Roll F

In Example No. 5, the heating roll (the heating and pressure applying member) F was manufactured in the same way as in Example No. 5. except that the core metal F was used as the core metal in place the core metal E (3) Evaluation by the Fixing Apparatus The characteristics of characteristics of thus-obtained heating roll F, the were evaluated in the same way as in Example No. 5. However, in this case the nip pressure in the evaluation bench was 441 N (45 kgf) and the stress the heating roll 20 received was 23 MPa. The result of the characteristic evaluation was that the scale deflection was 0.1 mm or less; and even at the time of the fixation of the whole-area-solid black/white image there was no paper wrinkles nor fixation unevenness occurred. Also, the warm-up time was 32 seconds. Each of those results is summarized in Table 1 below.

EXAMPLE NO. 7

Using the alloy (b) used in Example No. 6 there was a hollow-pipe-like core metal having an outside diameter 30 mm, an inner diameter of 29 mm, a thickness of 0.5 mm, and a length of 340 mm was manufactured.

The elastic-deformation index ϵ the core metal G thus obtained was measured in the same way as in Example No. 1. At this time, however, the load that was applied to the center of the peripheral surface of the core metal G was approximately 265 N (27 kgf) and the stress the core metal G received at a portion on a side opposite to that having a portion at which that load was applied was 60.0 MPa.

The thus-determined elastic-deformation index ϵ was $42\times10^{-6}$, whereby it was confirmed that elastic deformation was exhibited and it was also confirmed that the core metal G had a high-temperature elasticity characteristic.

(2) Manufacture of the Heating Roll F

In Example No. 5, the heating roll (the heating and pressure applying member) G was manufactured in the same way as in Example No. 5 except that the core metal G was used in place the core metal E.

(3) Evaluation by the Fixing Apparatus

The characteristic of the thus-obtained heating roll D was evaluated in the same way as in Example No. 1. The stress the heating roll 41 received in the evaluation bench was 45 MPa. The result of the characteristic evaluation was that the scale deflection was 0.1 mm or less; and even at the time of the fixation of the whole-area-solid black/white image no paper wrinkles nor fixation unevenness was generated. Also, the warm-up time was 24 seconds. Each of those results is shown in Table 1 below.

Comparative Example No. 1

(1) Manufacture of the Core Metal H

Using a Mg based Al alloy (A5056) a hollow-pipe-like core metal H having the configuration of that of Example No. 1 was manufactured.

The elastic-deformation index ϵ the core metal H thus obtained of was measured in the same way as in Example No. 1. The thus-determined elastic-deformation index ϵ was $400\times^{10-6}$, whereby it was confirmed that a bend resulting from plastic deformation occurred and it was also confirmed that the core metal H did not have a high-temperature elasticity characteristic.

(2) Manufacture of the Heating Roll H

In Comparative Example No. 1, the heating roll (the heating and pressure applying member) H was manufactured in the same way as in Example No. 1 except that the core metal H was used in place of the core metal.

(3) Evaluation by the Fixing Apparatus

The characteristic of the thus-obtained heating roll A was evaluated in the same way as in Example No. 1. The stress the heating roll 41 received in the evaluation bench was 35 MPa. The result of the characteristic evaluation was that the scale deflection was 1.3 mm or less; and even at the time of the fixation of the whole-area-solid black/white image, wrinkles occurred in to out of 10 sheets of paper and the degree of fixation at the central part of every sample was low with uneven fixation occurring. Also, the warm-up time was 33 seconds. Each of those results is shown in Table 1 below.

Comparative Example No. 2

(1) Manufacture of the Core Metal I

Using a Mg system Al alloy (A5056) there was manufactured a hollow-pipe-like core metal I that is 40 mm in having an outside diameter of 40 mm, an inner diameter of 39 mm, an thickness of 0.5 mm, and a length of 340 mm.

The elastic-deformation index $\epsilon$ of the core metal I thus obtained was measured in the same way as in Example No. 1. However, that the load that was applied to the center of the peripheral surface of the core metal I was approximately 490 N (50 kgf) and the stress the core metal I received at a portion on a side opposite to that having a portion at which that load had was applied was 60.0 MPa.

The thus-determined elastic-deformation index $\epsilon$ was $380\times10^{-6}$, whereby it was confirmed that a bend resulting from plastic deformation occurred and it was also confirmed that the core metal H did not have a high-temperature elasticity characteristic.

(2) Manufacture of the Heating Roll I

In Comparative Example No. 2, the heating roll (the heating and pressure applying member) I was manufactured in the same way as in Example No. 1 except that the core metal I was used in place of the core metal A.

(3) Evaluation by the Fixing Apparatus

The characteristic of the thus-obtained heating roll I was evaluated in the same way as in Example No. 1. The stress the heating roll 41 received in the evaluation bench was 25 MPa. The result of the characteristic evaluation was that the scale deflection was 1.4 mm or less; and even at the time of the fixation of the whole-area-solid black/white image, paper wrinkles were generated in 10 out of 10 sheets of paper and the degree of fixation at the central part of every sample was low with uneven fixation occurring. Also, the warm-up time was 29 seconds. Each of those results is shown in Table 1 below.

Comparative Example 3

(1) Manufacture of the Core Metal J

Using a Mg system Al alloy (A5056) there was manufactured a hollow-pipe-like core metal J having an outside diameter of 30 mm an, inner diameter of 22 mm, a thickness of 4 mm, a length of 340 mm.

The elastic-deformation index $\epsilon$ of the core metal J thus obtained was measured in the same way as in Example No. 1. However, the load that was applied to the center of the peripheral surface of the core metal J was approximately 1470 N (150 kgf) and the stress the core metal J received at a portion on a side opposite to that having a portion at which that load was applied was 60.0 MPa.

The thus-determined elastic-deformation index $\epsilon$ was $410\times10^{-6}$, whereby it was confirmed that a bend resulting from plastic deformation occurred and it was also confirmed that the core metal J did not have a high-temperature elasticity characteristic. Also, in the type of fixing apparatus having the core metal J with a thickness even as large as 4 mm, a load which generates a stress as large as 60.0 MPa can not be applied. Therefore, the load applied to the center of the peripheral surface of the core metal J was decreased to approximately 294 N (30 kgf) (the stress received on a side opposite to that having a portion where the load had been applied to the core metal J was 12.0 MPa). And in this condition there was determined elastic-deformation index $\epsilon$ in the same way. As a result, The index was $110\times10^{6}$. Namely, in that case, although elastic deformation was exhibited, it had a value that somewhat approached a value of plastic deformation.

(2) Manufacture of the Heating Roll J

In Comparative Example No. 3, the heating roll (the heating and pressure applying member) J was manufactured in the same way as in Example No. 1 except that the core metal J was used in place of the core metal E.

(3) Evaluation by the Fixing Apparatus

The characteristic of the thus-obtained heating roll J was evaluated in the same way as in Example No. 1. The stress the heating roll 41 received in the evaluation bench was 10 MPa. The result of the characteristic evaluation was that the scale deflection was 0.1 mm or less; and even at the time of the fixation of the whole-area-solid black/white image, neither paper wrinkles nor fixation unevenness was generated. But the warm-up time was 180 seconds with the result that the heating roll J had inferior instant startability characteristic. Each of those results is shown in Table 1 below.

Comparative Example No. 4

(1) Manufacture of the Core Metal K

Using a Mg system Al alloy (A5056) there was manufactured a hollow-pipe-like core metal K that was 50 mm in having an outside diameter of 50 mm, inner diameter of 43 mm, a thickness of 3.5 mm, and an length of 340 mm.

The elastic-deformation index $\epsilon$ thereof the core metal K thus obtained was measured in the same way as in Example No. 1. However, the load that was applied to the center of the peripheral surface of the core metal K was approximately 4410 N (450 kgf) and the stress the core metal K received at a portion on a side opposite to that having a portion at which that load had been applied be 60.0 MPa.

The thus-determined elastic-deformation index $\epsilon$ was $450\times10^{-6}$, whereby it was confirmed that a bend resulting from plastic deformation occurred and it was also confirmed that the core metal J did not have a high-temperature elasticity characteristic. Also, in the type of fixing apparatus having the core metal K with a thickness as large as 3.5 mm, a load generating a stress as large as 60.0 MPa can not be applied. Therefore, the load applied to the center of the peripheral surface of the core metal K was decreased down to approximately 980 N (100 kgf) (the stress received on a side opposite to that having a portion where the load had been applied to the core metal K was 14.0 MPa). And in this condition there was determined elastic-deformation index $\epsilon$ in the same way. As a result, that index was $120\times10^{-6}$. Namely, in that case, although elastic deformation was exhibited, it had a value that somewhat approached a value of plastic deformation.

(2) Manufacture of the Heating Roll K

On the peripheral surface of the thus-obtained core metal K, as the release layer, a PFA coating film the thickness of which is 30 $\mu$m was formed by powder electrostatic coating to thereby manufacture the heating roll (the heating and pressure applying member) K.

(3) Evaluation by the Fixing Apparatus

The thus-obtained heating roll K was assembled into an evaluation bench (a fixing apparatus for use for the characteristic evaluation) of the two-roll fixing apparatus of the structure illustrated in FIG. 4. Evaluation was thereby made of the characteristic of the heating roll K.

As the pressure roll 45 serving as the pressure applying member, there was manufactured a type having an iron-made core metal provided therein and having provided on that core metal an elastic layer 3 mm thick made of silicone rubber whose hardness is JIS A hardness of 30 degrees and whose outer diameter is 50 mm. The heating roll 41 was pressed by the pressure roll 45 under a nip pressure of 784 N (80 kgf). (At this time the stress that was received by the heating roll 41 was 5 MPa). Then heat was supplied by the heating source 43 to the heating roll 41 so that the surface thereof was 200° C. Then the resulting heating roll 41 was left as was for 5 hours. Thereafter, the amount of deformation of the heating roll 41 was measured by scale deflection. As a result, that deflection was 0.1 mm or less. Also, then, 10 sheets of whole-area-solid full color image were subjected to fixation on an A-4 sized recording material. As a result, the deflection was 0.1 mm or less and even at the time of the whole-area-solid full color image no paper wrinkles nor uneven fixation was. But the warm-up time was 180 seconds. As a result, it proved that the instant startability characteristic was inferior. Each of those results is summarily shown in Table 1 below.

Comparative Example No. 5

(1) Manufacture of the Core Metal L

Using a Mg system Al alloy (A5056) there was manufactured a hollow-pipe-like core metal K having an outside diameter of 30 mm, an inner diameter of 27 mm, a thickness of 15 mm, and a length of 340 mm.

The elastic-deformation index $\epsilon$ of the core metal L thus obtained in the same way as in Example No. 1. However, that the load that was applied to the center of the peripheral surface of the core metal L was approximately 735 N (75 kgf) and the stress the core metal L received at a portion on a side opposite to that having a corresponding portion at which that load was applied was 60.0 MPa.

The thus-determined elastic-deformation index $\epsilon$ was $430\times10^{-6}$, whereby it was confirmed that a bend resulting from plastic deformation occurred and it was also confirmed that the core metal L did not have a high-temperature elasticity characteristic.

(2) Manufacture of the Heating Roll L

In Comparative Example No. 5, the heating roll (the heating and pressure applying member) L was manufactured in the same way as in Example No. 1 except that the core metal L was used in place of the core metal A.

(3) Evaluation by the Fixing Apparatus

The characteristic of the thus-obtained heating roll L was evaluated in the same way as in Example No. 1. However, the nip pressure in the evaluation bench was 441 N (45 kgf) and the stress that was received by the heating roll 20 was 20 MPa. The result of the characteristic evaluation is as follows. The scale deflection was 1.2 mm. Also, even at the time of the fixation of the whole-area-solid full color image, 10 sheets of samples were all wrinkled or, in each of all those samples the degree of fixation was low at their central part. Namely, uneven fixation occurred. The warm-up time was 39 seconds. Each of those results is shown in Table 1 below.

Comparative Example No. 6

(1) Manufacture of the Core Metal M

As the material for the core metal, there was used an alloy (c) that was a Mn containing Al alloy having the following alloy composition.

(Composition of the Alloy (c))

Mn: 0.3%/ Mg: 0.1%/ Cu: 0.1%/ Al and a small amount of other components: the remaining components Using the alloy (c) there was manufactured a hollow-pipe-like core metal M having an outside diameter of 30 mm, an inner diameter of 27.6 mm, a thickness of 1.2 mm, and a length of 340 mm.

The elastic-deformation index $\epsilon$ of the core metal M thus obtained was measured in the same way as in Example No. 1. However, the load that was applied to the center of the peripheral surface of the core metal M was approximately 608 N (62 kgf) and the stress the core metal M received at a portion on a side opposite to that having a corresponding portion at which that load was applied was 60.0 MPa.

The thus-determined elastic-deformation index $\epsilon$ was $140\times10^{-6}$, whereby it was confirmed that a bend resulting from plastic deformation occurred and it was also confirmed that the core metal L did not have a high-temperature elasticity characteristic.

(2) Manufacture of the Heating Roll M

In Comparative Example No. 6, the heating roll (the heating and pressure applying member) M was manufactured in the same way as in Example No. 5 except that the core metal M was used in place of the core metal E.

(3) Evaluation by the Fixing Apparatus

The characteristic was evaluated of the thus-obtained heating roll F in the same way as in Example No. 5. However, that the nip pressure in the evaluation bench was 441 N (45 kgf) and the stress that was received by the heating roll 20 was 22MPa. The result of the characteristic evaluation is as follows. The scale deflection was 1.2 mm. Also, even at the time of the fixation of the whole-area-solid full color image, 8 sheets of 10 sheets of samples were wrinkled or, in each of all those 10-sheet samples the degree of fixation was low at their central part. Namely, uneven fixation occurred. The warm-up time was 34 seconds. Each of those results is shown in Table 1 below.

TABLE 1

| | core metal | | | measuring conditions under which elastic-deformation index $\epsilon$ is measured | | | Conditions at the time of fixation | | | | paper wrinkles | |
|---|---|---|---|---|---|---|---|---|---|---|---|---|
| | core metal notation | outside diameter (mm) | thickness (mm) | load N | stress (MPa) | elastic-deformation index $\epsilon$ | Load N | stress (MPa) | deflection (mm) | warm-up time (seconds) | specimens: number of wrinkled papers | fixation un-evenness |
| Example 1 | A | 25 | 1 | 343 | 60.0 | $30\times10^{-6}$ | 391 | 35 | 0.1 or less | 29 | 0/10 | none |
| Example 2 | B | 30 | 0.5 | 265 | 60.0 | $35\times10^{-6}$ | 391 | 45 | 0.1 or less | 23 | 0/10 | none |
| Example 3 | C | 40 | 0.5 | 480 | 60.0 | $33\times10^{-6}$ | 588 | 36 | 0.1 or less | 24 | 0/10 | none |
| Example 4 | D | 22 | 2.8 | 588 | 60.0 | $20\times10^{-6}$ | 588 | 30 | 0.1 or less | 32 | 0/10 | none |
| Example 5 | E | 35 | 0.8 | 568 | 60.0 | $29\times10^{-6}$ | 441 | 25 | 0.1 or less | 30 | 0/10 | none |
| Example 6 | F | 30 | 1.2 | 588 | 60.0 | $24\times10^{-6}$ | 441 | 23 | 0.1 or less | 32 | 0/10 | none |
| Example 7 | G | 30 | 0.5 | 265 | 60.0 | $42\times10^{-6}$ | 391 | 45 | 0.1 or less | 24 | 0/10 | none |
| Comparative Example 1 | H | 25 | 1 | 343 | 60.0 | $400\times10^{-5}$ | 391 | 35 | 1.3 | 33 | 10/10 | some |
| Comparative Example 2 | I | 40 | 0.5 | 490 | 60.0 | $380\times10^{-5}$ | 391 | 25 | 1.4 | 29 | 10/10 | some |
| Comparative Example 3 | J | 30 | 4 | 1470 | 60.0 | $410\times10^{-5}$ | 391 | 10 | 0.1 or less | 180 | 0/10 | none |
| Comparative Example 4 | K | 50 | 3.5 | 4410 | 60.0 | $450\times10^{-5}$ | 784 | 5 | 0.1 or less | 180 | 0/10 | none |

TABLE 1-continued

| | core metal | | | measuring conditions under which elastic-deformation index ε is measured | | | Conditions at the time of fixation | | | | paper wrinkles | |
|---|---|---|---|---|---|---|---|---|---|---|---|---|
| | core metal notation | outside diameter (mm) | thickness (mm) | load N | stress (MPa) | elastic-deformation index ε | Load N | stress (MPa) | deflection (mm) | warm-up time (seconds) | specimens: number of wrinkled papers | fixation un-evenness |
| Comparative Example 5 | L | 30 | 1.5 | 735 | 60.0 | $430 \times 10^{-5}$ | 441 | 20 | 1.2 | 36 | 10/10 | some |
| Comparative Example 6 | M | 30 | 1.2 | 608 | 60.0 | $140 \times 10^{-5}$ | 441 | 22 | 0.6 | 34 | 8/10 | some |

As has been described above, in the present invention, the materials are not selected according to the alloy characteristic at a normal temperature as in the prior art, and a heat fixing member is provided using as the core metal an aluminum alloy the composition ratio of which is defined in the present invention. Thus a heat fixing member can be obtained which prevents paper wrinkles or jamming due to the conveyance of the paper after it is left as is in a state of being heated and pressurized for long period. It also prevents wrinkles and paper jam due to the deterioration in the paper conveyance, the deterioration in the toner fixation, and the deterioration in the paper conveyance. In addition, an heat fixing member that can achieve the instant fixability is obtained.

Also, because it becomes possible to make the heat fixing member small in thickness and small in diameter, this causes to the fixing apparatus and the image formation apparatus be small in size and light in weight. Further, while the conventional heat fixing member which is thin and has a small diameter used a material such as iron or stainless steel, a required level of strength is obtained with the use of an aluminum alloy. In addition, it is possible to make uniform the temperature distribution in the axial direction of the heat fixing member. Therefore, even when after continuous fixation of small-sized from papers large-sized form papers are fixed, fixation unevenness at some parts becomes unlikely to occur. Also, because it is difficult the fixing apparatus to be deformed when left intact for a long period after being heated and pressurized, it is unnecessary for the fixing apparatus to have a nip-releasing mechanism. This enables a decrease in cost of the fixing apparatus.

Further, according to the present invention, it is possible to provide an image formation apparatus that uses a heat and pressure fixing apparatus having the above-described excellent characteristics.

What is claimed is:

1. A heat fixing member for applying heat and pressure to a recording material in a fixing apparatus in order to fix an unfixed toner image carried thereon, the heat fixing member comprising:

a cylindrical core metal; and a release layer formed on a peripheral surface of the core metal, wherein the thickness of the core metal is 2.8 mm or less, and the core metal is formed of a material which is elastically deformed by a stress of 60.0 MPa in an environment of 210° C.

2. A heat fixing member according to claim 1, wherein the thickness of the core metal is no less than 0.5 mm.

3. A heat fixing member according to claim 1, wherein the core metal is formed of an aluminum alloy.

4. A heat fixing member according to claim 1, wherein the outer diameter of the core metal is from 20 to 40 mm.

5. A heat fixing member according to claim 1, wherein the release layer consists of a fluorine containing polymer material.

6. A heat fixing member according to claim 1, wherein the thickness of the release layer is from 10 to 100 μm.

7. A heat fixing member according to claim 1, wherein at least an elastic layer is formed between the core metal and the release layer.

8. A heat fixing member according to claim 7, wherein the elastic layer consists of silicone rubber.

9. A heat fixing member according to claim 7, wherein the thickness of the elastic layer is from 50 μm to 1.0 mm.

10. A heat and pressure fixing apparatus for applying heat and pressure to a recording material in order to fix an unfixed toner image carried thereon, the heat and pressure fixing apparatus comprising:

a cylindrical heat fixing member;

a pressure applying member which is press-contacted with a peripheral surface of the heat fixing member to form a nip portion therebetween, through which the recording material is inserted; and a heat source disposed inside the heat fixing member, wherein the heat fixing member includes a core metal and a release layer formed on a peripheral surface of the core metal, the thickness of the core metal is from 0.5 mm to 2.8 mm, and the core metal is formed of an aluminum alloy that is elastically deformed by a stress of 60.0 MPa in an environment of 210° C.

11. A heating and pressure fixing apparatus according to claim 10, wherein the diameter of the core metal is from 20 to 40 mm.

12. A heat and pressure fixing apparatus according to claim 10, wherein the release layer consists of a fluorine containing polymer material.

13. A heat and pressure fixing apparatus according to claim 10, wherein the thickness of the release layer is from 10 to 100 μm.

14. A heat and pressure fixing apparatus according to claim 10, wherein at least an elastic layer is formed between the core metal and the release layer.

15. A heat and pressure fixing apparatus according to claim 10, wherein the elastic layer consists of silicone rubber.

16. A heat and pressure fixing apparatus according to claim 10, wherein the thickness of the elastic layer is from 50 μm to 1.0 mm.

17. A heat and pressure fixing apparatus according to claim 10, wherein heat and pressure is applied to the recording material by the heat fixing member being heated at a temperature of 100 to 210° C. and a load being applied thereto by the pressure applying member so as to provide a stress of no more than 60.0 MPa.

18. A heat and pressure fixing apparatus according to claim 10, wherein the pressure applying member includes an endless belt and a presser disposed inside the endless belt, the endless belt being wound around the heat fixing member at a predetermined angle to form a nip portion between the endless belt and the heat fixing member, through which a recording material is inserted, and a strain is caused on the surface of the heat fixing member by pressing the presser against the heat fixing member via the endless belt at the nip portion.

19. A heat and pressure fixing apparatus according to claim 18, wherein the presser is a pressure pad, and a nip pressure of the pressure pad that presses the heat fixing member is locally large in the vicinity of an exit of the nip portion.

20. A heat and pressure fixing apparatus for applying heat and pressure to a recording material in order to fix the unfixed toner image which is carried toner image thereon, the fixing apparatus comprising:

a cylindrical heat fixing member;

a pressure applying member that is press-contacted with a peripheral surface of the heat fixing member to form a nip portion through which the recording material is inserted; and a heat source disposed inside the heat fixing member, wherein the heat fixing member includes a core metal and a release layer formed around the core metal, the thickness of the core metal is no more than 2.8 mm, and at the time of fixation the heat fixing member is elastically deformed by a load applied so as to produce a stress of no more than 60.0 MPa from the pressure applying member.

21. A heat and pressure fixing apparatus according to claim 20, wherein the load applied to the heat fixing member by the pressure applying member produces a stress of no less than 25.0 MPa.

22. An image formation apparatus, comprising:

an electrostatic latent image formation device that forms an electrostatic latent image on an electrostatic latent image carrier;

a development device which develops the electrostatic image by the use of toner;

a transfer device which transfers the developed toner image onto a recording material; and a fixation device which fixes the transferred toner image on the recording material, wherein the fixation device includes a cylindrical heat fixing member, a pressure applying member which is press-contacted with a peripheral surface of the heat fixing member to form a nip portion through which the recording material is inserted, and a heat source that is disposed inside the heating fixing member, and the heat fixing member include a core metal and a release layer formed on the peripheral surface of the core metal, and wherein the thickness of the core metal is from 0.5 mm to 2.8 mm, and the core metal is formed of an aluminum alloy that is elastically deformed by a stress of 60.0 MPa in an environment of 210° C.

23. An image formation apparatus comprising:

an electrostatic latent image formation device forming an electrostatic latent image on an electrostatic latent image carrier;

a development device which develops the electrostatic image by the use of toner;

a transfer device which transfers the developed toner image onto a recording material; and a fixation device which fixes the transferred toner image on the recording material, wherein the fixation device includes a cylindrical heat fixing member, a pressure applying member which is press-contacted with a peripheral surface of the heat fixing member to form a nip portion through which the recording material is inserted, and a heat source that is disposed inside the heat fixing member, and the heat fixing member includes a core metal and a release layer formed on the peripheral surface of the core metal, the thickness of the core metal is no more than 2.8 mm, and at the time of fixation the heat fixing member is elastically deformed by a load applied so as to produce a stress from the pressure applying member of no more than 60.0 MPa.

* * * * *